US010787760B2

(12) United States Patent
Minegishi et al.

(10) Patent No.: US 10,787,760 B2
(45) Date of Patent: Sep. 29, 2020

(54) EMBROIDERY SEWING MACHINE, THREAD COLOR GROUPING METHOD, AND PROGRAM

(71) Applicant: JANOME SEWING MACHINE CO., LTD., Tokyo (JP)

(72) Inventors: Yumi Minegishi, Tokyo (JP); Yumiko Kambara, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 53 days.

(21) Appl. No.: 16/278,780

(22) Filed: Feb. 19, 2019

(65) Prior Publication Data

US 2019/0271106 A1 Sep. 5, 2019

(30) Foreign Application Priority Data

Mar. 1, 2018 (JP) ..... 2018-036969

(51) Int. Cl.
*D05C 5/02* (2006.01)
*D05C 5/06* (2006.01)

(52) U.S. Cl.
CPC *D05C 5/02* (2013.01); *D05C 5/06* (2013.01)

(58) Field of Classification Search
CPC ..... D05C 5/06; D05C 5/02; D05C 3/02
USPC ..... 700/138
See application file for complete search history.

(56) References Cited

U.S. PATENT DOCUMENTS 5,836,259 A * 11/1998 Tanaka ..... D05B 19/105 112/102.5
5,904,109 A * 5/1999 Asano ..... D05B 19/12 112/102.5
6,012,402 A * 1/2000 Sekine ..... D05B 19/105 112/102.5
6,407,745 B1 * 6/2002 Yamada ..... G06T 11/60 345/593
2008/0229988 A1 * 9/2008 Kishi ..... D05C 5/04 112/102.5
2010/0017011 A1 * 1/2010 Goldman ..... D05B 19/08 700/138

(Continued)

FOREIGN PATENT DOCUMENTS

JP 2010-179017 A 8/2010
JP 2011-010719 A 1/2011

*Primary Examiner* — Danny Worrell
(74) *Attorney, Agent, or Firm* — Nakanishi IP Associates, LLC

(57) ABSTRACT

A thread color comparison unit compares and judges whether or not a comparison target is the same as a comparison reference with a given thread color of a given design stored in a thread color storage unit as the comparison target and with a given thread color of another given design that differs from the given design as the comparison reference. A thread color grouping unit performs grouping for the comparison target and the comparison reference included in different designs when the comparison target and the comparison reference are the same color. When the thread color comparison unit has judged that the comparison target is the same as the comparison reference, the thread color storage unit stores information such that the comparison target is to be sewn together with the comparison reference that has been judged to be the same, and the sewing data for the comparison target is removed.

15 Claims, 17 Drawing Sheets

(56) References Cited

U.S. PATENT DOCUMENTS

| | | | | |
|---|---|---|---|---|
| 2010/0305744 | A1* | 12/2010 | Yamada | D05C 5/04 700/138 |
| 2010/0313803 | A1* | 12/2010 | Okuyama | D05C 11/00 112/102.5 |
| 2012/0116569 | A1* | 5/2012 | Yamada | D05C 5/04 700/138 |
| 2012/0197430 | A1* | 8/2012 | Maki | D05C 11/16 700/138 |
| 2012/0303152 | A1* | 11/2012 | Yamada | D05B 19/08 700/138 |
| 2015/0144043 | A1* | 5/2015 | Maki | D05C 5/00 112/102.5 |
| 2016/0053420 | A1* | 2/2016 | Kongo | D05B 19/10 112/102.5 |
| 2017/0350051 | A1* | 12/2017 | Angelakis | D05B 19/12 |
| 2018/0057985 | A1* | 3/2018 | Imaizumi | D05B 19/10 |
| 2019/0062971 | A1* | 2/2019 | Kamihira | D05C 5/04 |
| 2019/0271106 | A1* | 9/2019 | Minegishi | D05C 3/02 |

* cited by examiner (A)

FIG.5

| DESIGN(1) | |
|---|---|
| 1 | 237 |
| 2 | 001 |
| 3 | 260 |
| 4 | 257 |
| 5 | 258 |
| 6 | 205 |
| 7 | 259 |
| 8 | 003 |
| 9 | 272 |

| DESIGN(2) | |
|---|---|
| 10 | 002 |

| DESIGN(3) | |
|---|---|
| 11 | 257 |
| 12 | 003 |
| 13 | 252 |
| 14 | 237 |
| 15 | 002 |

| DESIGN(4) | |
|---|---|
| 16 | 205 |
| 17 | 237 |
| 18 | 002 |
| 19 | 205 |

| DESIGN(5) | |
|---|---|
| 20 | 272 |
| 21 | 003 |
| 22 | 221 |

| DESIGN(6) | |
|---|---|
| 23 | 002 |
| 24 | 001 |

| DESIGN(7) | |
|---|---|
| 25 | 253 |
| 26 | 225 |
| 27 | 221 |
| 28 | 220 |

| DESIGN(8) | |
|---|---|
| 29 | 203 |
| 30 | 003 |
| 31 | 001 |
| 32 | 237 |

| DESIGN(9) | |
|---|---|
| 33 | 272 |
| 34 | 003 |
| 35 | 272 |
| 36 | 001 |

FIG. 15

| BEFORE THREAD COLOR GROUPING | |
|---|---|
| 1 | 237 |
| 2 | 001 |
| 3 | 260 |
| 4 | 257 |
| 5 | 258 |
| 6 | 205 |
| 7 | 259 |
| 8 | 003 |
| 9 | 272 |
| 10 | 002 |
| 11 | 257 |
| 12 | 003 |
| 13 | 252 |
| 14 | 237 |
| 15 | 002 |
| 16 | 205 |
| 17 | 237 |
| 18 | 002 |
| 19 | 205 |
| 20 | 272 |
| 21 | 003 |
| 22 | 221 |
| 23 | 002 |
| 24 | 001 |
| 25 | 253 |
| 26 | 225 |
| 27 | 221 |
| 28 | 220 |
| 29 | 203 |
| 30 | 003 |
| 31 | 001 |
| 32 | 237 |
| 33 | 272 |
| 34 | 003 |
| 35 | 272 |
| 36 | 001 |

(A)

| SEWING ORDER | SEWING ORDER BEFORE GROUPING | SEWING ORDER IN DESIGN | COLOR CODE |
|---|---|---|---|
| 1 | 1 | 1__1 | 237 |
| 2 | 2 | 1__2 | 001 |
| 3 | 3 | 1__3 | 260 |
| 4 | 4 | 1__4 | 257 |
| | 11 | 3__1 | 257 |
| 5 | 5 | 1__5 | 258 |
| 6 | 6 | 1__6 | 205 |
| | 16 | 4__1 | 205 |
| 7 | 7 | 1__7 | 259 |
| | 8 | 1__8 | 003 |
| 8 | 12 | 3__2 | 003 |
| 9 | 13 | 3__3 | 252 |
| | 14 | 3__4 | 237 |
| 10 | 17 | 4__2 | 237 |
| | 10 | 2__1 | 002 |
| | 15 | 3__5 | 002 |
| 11 | 18 | 4__3 | 002 |
| | 23 | 6__1 | 002 |
| 12 | 19 | 4__4 | 205 |
| | 9 | 1__9 | 272 |
| 13 | 20 | 5__1 | 272 |
| | 33 | 9__1 | 272 |
| 14 | 21 | 5__2 | 003 |
| 15 | 25 | 7__1 | 253 |
| 16 | 26 | 7__2 | 225 |
| | 22 | 5__3 | 221 |
| 17 | 27 | 7__3 | 221 |
| 18 | 28 | 7__4 | 220 |
| 19 | 29 | 8__1 | 203 |
| 20 | 30 | 8__2 | 003 |
| | 34 | 9__2 | 003 |
| | 24 | 6__2 | 001 |
| 21 | 31 | 8__3 | 001 |
| 22 | 32 | 8__4 | 237 |
| 23 | 35 | 9__3 | 272 |
| 24 | 36 | 9__4 | 001 |

(B)

EMBROIDERY SEWING MACHINE, THREAD COLOR GROUPING METHOD, AND PROGRAM

CROSS REFERENCE TO RELATED APPLICATIONS

This application is based on and claims the benefit of priority to Japanese Patent Application No. 2018-036969 filed on Mar. 1, 2018, the contents of which are hereby incorporated by reference in their entirety.

BACKGROUND OF THE INVENTION

1. Field of the Invention

The present invention relates to an embroidery sewing machine, a thread color grouping method, and a program.

2. Description of the Related Art

As an ordinary operation of a sewing machine having an embroidery sewing function, such a sewing machine combines multiple design stitching data so as to form a single overall design, thereby providing various kinds of embroidery sewing.

Furthermore, various kinds of colors are employed for such a design. As ordinary embroidery, multiple colors are used for a single design. In a case of combining multiple designs each formed of multiple colors, such an overall design is provided with a more complex color composition.

However, in a case of performing embroidery sewing of an overall design configured as a combination of multiple designs formed of multiple colors, such an arrangement requires a thread to be changed every time the color to be used is changed. This arrangement requires a troublesome thread changing step, leading to an issue of degraded embroidery efficiency.

In order to address the aforementioned issue, Patent document 1 discloses a sewing machine including: an apparatus that selects and arranges multiple design sewing data so as to generate an overall design; a grouping apparatus that groups the multiple design sewing data into data groups each having the same color composition; an apparatus that edits the design sewing data so as to allow the multiple design sewing data thus grouped to be consecutively sewn for each color; and an apparatus that stores the design sewing data edited by the editing apparatus.

Also, Patent document 2 discloses a sewing system including multiple multi-needle sewing machines. With such a sewing system, thread spool color data, the IDs of the multi-needle sewing machines, and the embroidery data are acquired. Comparison is made between the thread color data included in the embroidery data and the thread spool color data. The sewing machine to be used in next in the sewing order is selected and determined from among the multiple multi-needle sewing machines based on the comparison result. A partial design is assigned to the sewing machine thus selected. Subsequently, specified data is transmitted to the sewing machine thus selected. Upon receiving the specified data, the sewing machine performs sewing of the partial design specified by the specified data on a cloth to be sewn.

RELATED ART DOCUMENTS

Patent Documents

[Patent document 1]

Japanese Patent Application Laid Open No. 2010-179017

[Patent document 2]

Japanese Patent Application Laid Open No. 2011-10719

However, with the technique described in Patent document 1, sewing is performed following a sewing stacking order. With such an arrangement, particular multiple design sewing data having the same color composition and the same color sewing order are grouped. Accordingly, in a case in which there is a difference in the color order or the number of colors, such an arrangement is not able to provide thread grouping, leading to an issue of poor versatility.

With the technique described in Patent document 2, comparison is made between the thread color to be used in sewing and the thread colors set for the sewing machine. When the thread color to be used is the same as any of the thread colors set beforehand, the system starts sewing. When the thread color to be used is not the same as any of the thread colors set beforehand, the system suspends the sewing. Accordingly, an application of the system is restricted to multi-needle sewing machines each supporting multiple thread colors, which is an issue.

SUMMARY OF THE INVENTION

The present invention has been made in order to address the aforementioned issue. Accordingly, it is a purpose of the present invention to provide an embroidery sewing machine having improved versatility and a reduced number of times the thread spool is to be replaced, a thread color grouping method, and a program.

Embodiment 1

One or more embodiments of the present invention provide an embroidery sewing machine comprising: a thread color storage unit that stores thread colors to be sewn in a sewing order for each of multiple designs to be sewn; a thread color comparison unit that compares and judges whether or not a comparison target is the same as a comparison reference with a given thread color of a given design stored in the thread color storage unit as the comparison target and with another given thread color of another given design that differs from the given design as the comparison reference; and a thread color grouping unit that groups the comparison target with the comparison reference when they have the same color. When the thread color comparison unit has judged that the comparison target is the same as the comparison reference, the thread color storage unit stores information such that the comparison target is to be sewn together with the comparison reference that has been judged to be the same, and the sewing data for the comparison target is removed.

Embodiment 2

One or more embodiments of the present invention provide the embroidery sewing machine. When any of comparison references to be sewn between the given comparison target and the given comparison reference that have been judged to be the same has already been grouped with a thread color of the comparison target design that differs from the color of the given comparison target, the thread color grouping is not executed.

Embodiment 3

One or more embodiments of the present invention provide the embroidery sewing machine. The thread color comparison unit compares the comparison target with the comparison reference in a sewing order, or otherwise in an order that is the reverse of the sewing order, for each of the comparison targets that form a comparison target design. When the comparison is made in the sewing order for the design formed with the comparison target, the comparison reference is set to a thread color of other designs to be sewn before the design formed with the comparison target. When the comparison is made in an order that is the reverse of the sewing order for the design formed with the comparison target, the comparison reference is set to a thread color of other designs to be sewn after the design formed with the comparison target.

Embodiment 4

One or more embodiments of the present invention provide the embroidery sewing machine further comprising a comparison target changing unit that changes the comparison target as appropriate based on comparison results obtained by the thread color comparison unit. In a case in which the comparison target is compared with the comparison reference in the sewing order for each comparison target that forms a comparison target design, when the thread color comparison unit has judged that the comparison target is not the same as the comparison reference, the comparison target is compared with the comparison reference in an order that is the reverse of the sewing order, or otherwise a predetermined thread color of a design to be sewn next in the sewing order is compared as the comparison target with the comparison reference.

Embodiment 5

One or more embodiments of the present invention provide the embroidery sewing machine further comprising: a sewing order switching unit that switches the sewing order in which the multiple designs are to be sewn; a sewing count calculation unit that calculates the number of times sewing is to be performed for the multiple designs subjected to the thread color grouping supported by the thread color grouping unit when the sewing order switching unit switches the sewing order; and a sewing order determining unit that determines the order for the multiple designs. The sewing order determining unit determines the sewing order that provides the minimum number of times sewing is to be performed calculated by the sewing count calculation unit, and the thread color storage unit stores the sewing order thus determined and the thread color grouping result obtained by the thread color grouping unit.

Embodiment 6

One or more embodiments of the present invention provide a thread color grouping method employed in an apparatus comprising: a thread color storage unit that stores thread colors to be sewn in a sewing order for each of multiple designs to be sewn; a thread color comparison unit; and a thread color grouping unit. The thread color grouping method comprises: a first step in which the thread color comparison unit judges whether or not a comparison target is the same as a comparison reference with a given thread color of a given design stored in the thread color storage unit as the comparison target and with another given thread color of another given design that differs from the given design as the comparison reference; and a second step in which the thread color grouping unit groups the comparison target with the comparison reference when they are the same color. In the second step, when the thread color comparison unit has judged that the comparison target is the same as the comparison reference, the thread color storage unit stores information such that the comparison target is to be sewn together with the comparison reference that has been judged to be the same, and the sewing data for the comparison target is removed.

Embodiment 7

One or more embodiments of the present invention provide the thread color grouping method. In the second step, when any of comparison references to be sewn between the given comparison target and the given comparison reference that have been judged to be the same in the first step has already been grouped with a thread color of the given comparison target design that differs from the color of the comparison target, the thread color grouping is not executed.

Embodiment 8

One or more embodiments of the present invention provide the thread color grouping method. In the first step, the thread color comparison unit compares the comparison target with the comparison reference in a sewing order, or otherwise in an order that is the reverse of the sewing order, for each of the comparison targets that form a comparison target design. When the comparison is made in the sewing order for the design formed with the comparison target, the comparison reference is set to a thread color of another design to be sewn before the design formed with the comparison target. When the comparison is made in an order that is the reverse of the sewing order for the design formed with the comparison target, the comparison reference is set to a thread color of another design to be sewn after the design formed with the comparison target.

Embodiment 9

One or more embodiments of the present invention provide the thread color grouping method. The apparatus further comprises a comparison target changing unit that changes the comparison target as appropriate based on comparison results obtained in the first step. The thread color grouping method further comprises a third step in which, with the comparison target changing unit, in a case in which the comparison target is compared with the comparison reference in the sewing order for each comparison target that forms a comparison target design, when the thread color comparison unit has judged that the comparison target is not the same as the comparison reference, the comparison target is compared with the comparison reference in an order that is the reverse of the sewing order, or otherwise a predetermined thread color of a design to be sewn next in the sewing order is compared as the comparison target with the comparison reference.

Embodiment 10

One or more embodiments of the present invention provide the thread color grouping method. The apparatus further comprises a sewing order switching unit, a sewing count calculation unit, and a sewing order determining unit. The thread color grouping method further comprises: a fourth step in which the sewing order switching unit switches the sewing order in which the multiple designs are to be sewn;

a fifth step in which the sewing count calculation unit calculates the number of times sewing is to be performed for the multiple designs subjected to the thread color grouping performed in the second step when the sewing order is switched in the fourth step; and a sixth step in which the sewing order determining unit determines the sewing order that provides the minimum number of times sewing is to be performed calculated in the fifth step, and the thread color storage unit stores the sewing order thus determined and the thread color grouping result obtained in the second step.

Embodiment 11

One or more embodiments of the present invention provide a non-transitory recording medium that records a program for instructing a computer to execute a thread color grouping method employed in an apparatus comprising: a thread color storage unit that stores thread colors to be sewn in a sewing order for each of multiple designs to be sewn; a thread color comparison unit; and a thread color grouping unit. The thread color grouping method comprises: a first step in which the thread color comparison unit judges whether or not a comparison target is the same as a comparison reference with a given thread color of a given design stored in the thread color storage unit as the comparison target and with another given thread color of another given design that differs from the given design as the comparison reference; and a second step in which the thread color grouping unit groups the comparison target with the comparison reference when they are the same color. In the second step, when the thread color comparison unit has judged that the comparison target is the same as the comparison reference, the thread color storage unit stores information such that the comparison target is to be sewn together with the comparison reference that has been judged to be the same, and the sewing data for the comparison target is removed.

Embodiment 12

One or more embodiments of the present invention provide a non-transitory recording medium that records the program. In the second step, when any of comparison references to be sewn between the given comparison target and the given comparison reference that have been judged to be the same in the first step has already been grouped with a thread color of the given comparison target design that differs from the color of the comparison target, the thread color grouping is not executed.

Embodiment 13

One or more embodiments of the present invention provide a non-transitory recording medium that records the program. In the first step, the thread color comparison unit compares the comparison target with the comparison reference in a sewing order, or otherwise in an order that is the reverse of the sewing order, for each of the comparison targets that form a comparison target design. When the comparison is made in the sewing order for the design formed with the comparison target, the comparison reference is set to a thread color of another design to be sewn before the design formed with the comparison target. When the comparison is made in an order that is the reverse of the sewing order for the design formed with the comparison target, the comparison reference is set to a thread color of another design to be sewn after the design formed with the comparison target.

Embodiment 14

One or more embodiments of the present invention provide a non-transitory recording medium that records the program. The apparatus further comprises a comparison target changing unit that changes the comparison target as appropriate based on comparison results obtained in the first step. The thread color grouping method further comprises a third step in which, with the comparison target changing unit, in a case in which the comparison target is compared with the comparison reference in the sewing order for each comparison target that forms a comparison target design, when the thread color comparison unit has judged that the comparison target is not the same as the comparison reference, the comparison target is compared with the comparison reference in an order that is the reverse of the sewing order, or otherwise a predetermined thread color of a design to be sewn next in the sewing order is compared as the comparison target with the comparison reference.

Embodiment 15

One or more embodiments of the present invention provide a non-transitory recording medium that records the program. The apparatus further comprises a sewing order switching unit, a sewing count calculation unit, and a sewing order determining unit. The thread color grouping method further comprises: a fourth step in which the sewing order switching unit switches the sewing order in which the multiple designs are to be sewn; a fifth step in which the sewing count calculation unit calculates the number of times sewing is to be performed for the multiple designs subjected to the thread color grouping performed in the second step when the sewing order is switched in the fourth step; and a sixth step in which the sewing order determining unit determines the sewing order that provides the minimum number of times sewing is to be performed calculated in the fifth step, and the thread color storage unit stores the sewing order thus determined and the thread color grouping result obtained in the second step.

With at least one embodiment of the present invention, such an arrangement provides an embroidery sewing machine, a thread color grouping method, and a program, which allow the number of times thread spool replacement is to be performed to be reduced and which have improved versatility.

BRIEF DESCRIPTION OF THE DRAWINGS

FIG. 5 is a diagram showing the thread color codes of a design group shown in FIG. 2 arranged according to the sewing order.

FIG. 15 is a diagram showing the sewing order before the thread color grouping and the result thereof after the thread color grouping.

DETAILED DESCRIPTION

First Embodiment

Description will be made below regarding a first embodiment of the present invention with reference to FIGS. 1 through 15.

Figure 2:
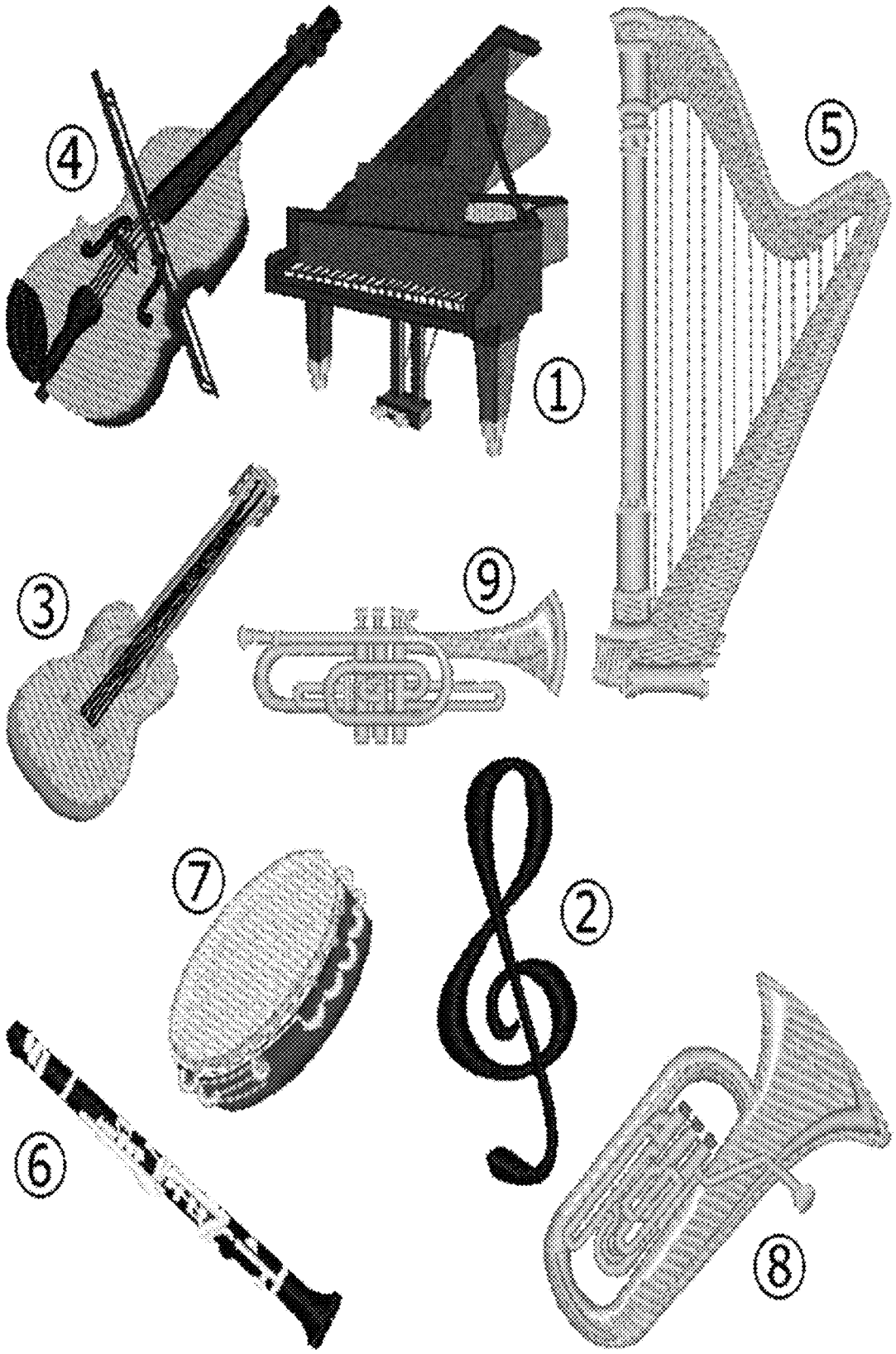
FIG. 2 is a diagram showing an example of embroidery designs according to the first embodiment of the present invention.

It should be noted that "design" in this specification represents a combination of colors (thread colors) and a shape defined in a closed region that is not in contact with other designs. FIG. 2 shows nine designs, i.e., a piano design (1) through a trumpet design (9). Each single design is formed of "design components" each of which is a shape formed in one or multiple colors (thread colors). Examples of such a design component include the "bear's ear design" shown in FIG. 4. That is to say, each "design" is formed of "design components" each of which is configured as a combination of "thread color" and "shape".

Typically, in the sewing of a given design, multiple design components are sewn in a predetermined order. If the multiple design components are sewn in a different order, this will form an overall design that differs from the desired design. For example, in a bear design shown in FIG. 4, if the "ear design", which is a design component, is sewn in a different order, a different overall design is formed (see the bear designs indicated by the circle and "X" in FIG. 4). The present invention has been made assuming that such multiple designs are sewn.

Furthermore, the embroidery sewing machines according to the first embodiment and the second embodiment may each be configured as any one from among a single-needle embroidery sewing machine and a multi-needle embroidery sewing machine.

[Configuration of Embroidery Sewing Machine]

Description will be made with reference to FIG. 1 regarding a configuration of an embroidery sewing machine 100 according to the present embodiment.

Figure 1:
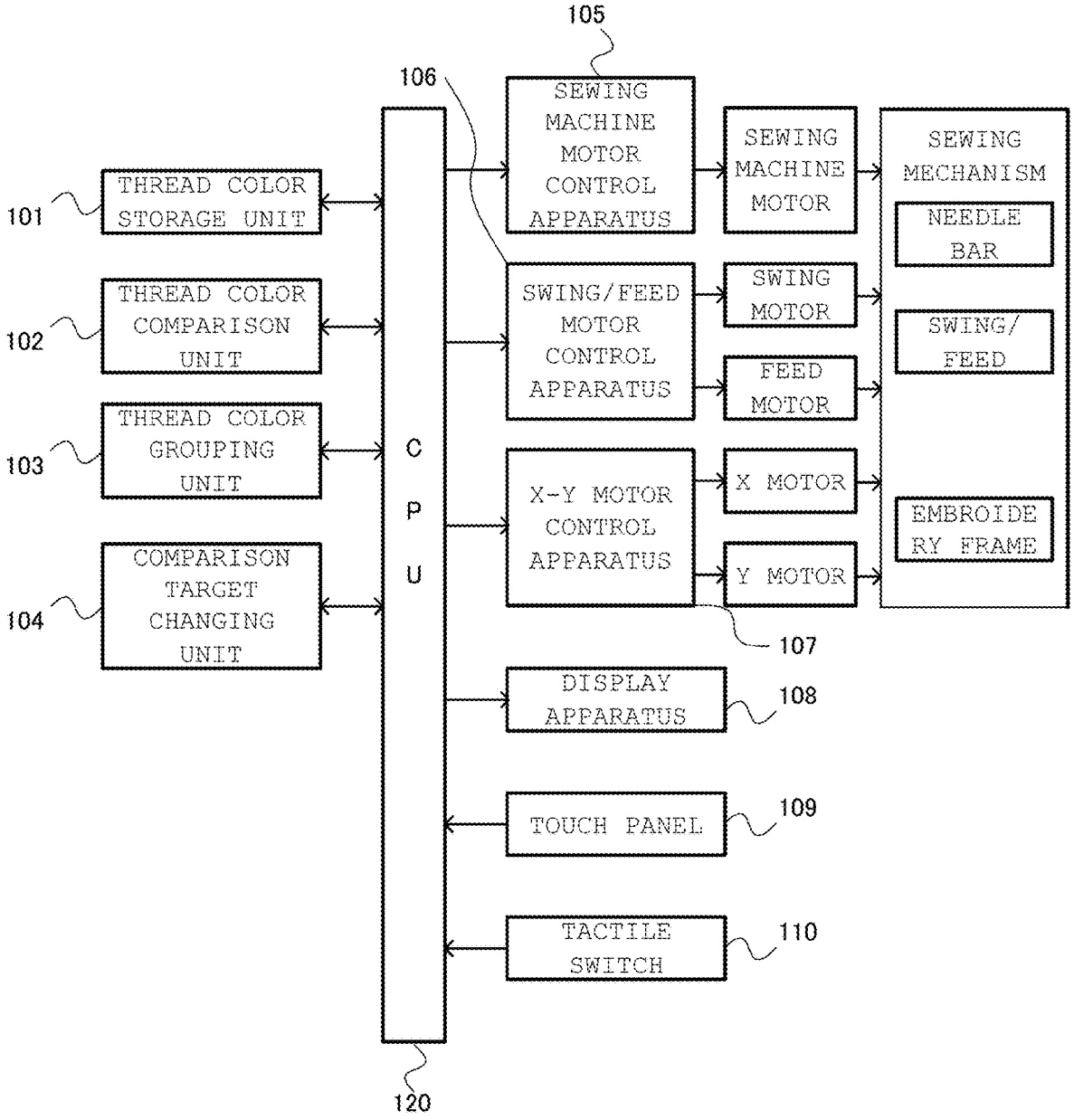
FIG. 1 is a configuration diagram showing an embroidery sewing machine according to a first embodiment of the present invention.

As shown in FIG. 1, the embroidery sewing machine 100 according to the present embodiment is configured including a thread color storage unit 101, a thread color comparison unit 102, a thread color grouping unit 103, a comparison target changing unit 104, a sewing machine motor control apparatus 105, a swing/feed motor control apparatus 106, an X-Y motor control apparatus 107, a display apparatus 108, a touch panel 109, a tactile switch 110, and a central processing unit (CPU) 120.

The thread color storage unit 101 is configured as unshown RAM or the like, and stores the thread colors of design components in a sewing order to be sewn so as to form multiple designs.

The thread color comparison unit 102 selects, as a comparison target, a given thread color that forms a given design stored in the thread color storage unit 101. Furthermore, the thread color comparison unit 102 selects, as a comparison reference, any of the thread colors that form a design that differs from the given design. The thread color comparison unit 102 compares the comparison target and the comparison reference, and judges whether or not they are the same.

Furthermore, the thread color comparison unit 102 compares the comparison target with the comparison reference in a sewing order, in which a design formed with the comparison target is to be sewn, or otherwise an order that is the reverse of the sewing order. In a case in which the comparison is made in the sewing order, a thread color of another design to be sewn before the sewing of the comparison target design is selected as the comparison reference. Conversely, in a case in which the comparison is made in a reverse order that is the reverse of the sewing order, a thread color of another design to be sewn after the sewing of the comparison target design is selected as the comparison reference.

The thread color grouping unit 103 groups the comparison target with the comparison reference when they are the same color. That is to say, the thread color grouping unit 103 groups the thread colors that are the same color selected from among multiple designs.

Furthermore, when the thread color comparison unit 102 has judged that the comparison target and the comparison reference are the same, the thread color grouping unit 103 instructs the thread color storage unit 101 to store information that indicates that the comparison target is to be sewn together with the comparison reference that has been judged by the color comparison unit 102 to be the same, and deletes the comparison target from its original position in the sewing order.

Figure 14:
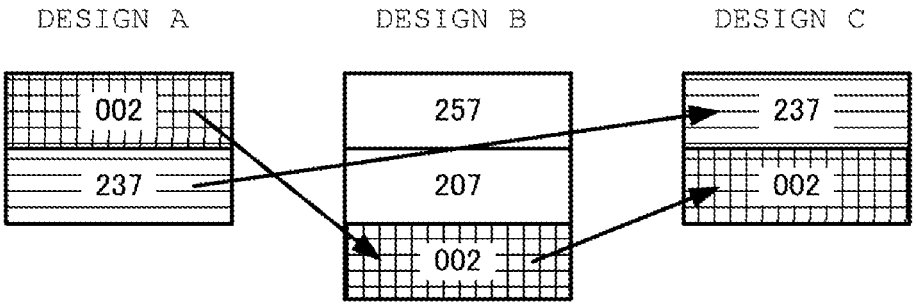
FIG. 14 is a diagram showing an example in which the thread color to be judged has already been grouped with another thread color of another design having the same color code.

Furthermore, even when judgment has been made that the comparison target and the comparison reference are the same color, when any of thread colors to be sewn between the comparison target and the comparison reference has already been grouped with another thread color of a comparison target design formed with the comparison target, the thread grouping unit 103 does not perform the thread color grouping for them. Moreover, even in a case that does not fall under the aforementioned case, in a case as shown in FIG. 14, the thread color grouping unit 103 does not perform thread color grouping for the comparison target and the comparison reference. In this example, the comparison target (thread color code "002" of the design B) has already been grouped (with the thread color code "002" of the design A). Furthermore, another thread color (thread color code "237" of the design C) of the comparison reference design formed of the comparison reference (thread color code "002" of the design C) to be grouped with the comparison target has already been grouped with yet another thread color (thread color code "237" of the design A). If the thread color grouping is performed for the comparison target and the comparison reference, this changes the original sewing order for the design (design A) that has been subjected to the thread color grouping, from the original sewing order (of the code "002" to the code "237") to a sewing order (of the code "237" to the code "002"). In this case, the thread color grouping for the comparison target and the comparison reference is not performed. Detailed description will be made later.

The comparison target changing unit 104 changes the comparison target as appropriate based on the comparison result obtained by the thread color comparison unit 102.

Furthermore, when the thread color comparison unit 102 has compared the comparison target with the comparison reference in the sewing order for each of comparison targets that form a comparison target design, and when judgment has been made that they are not the same, the thread color comparison unit 102, compares the comparison target with the comparison reference for each of the comparison targets as selected in a reversed order that is the reverse of the sewing order for the comparison target design. Alternatively, the comparison target is changed to a given thread color of a design to be sewn in next, and the comparison target thus updated is compared with the comparison reference.

The sewing machine motor control apparatus 105 is electrically connected to the CPU 120. The sewing machine motor control apparatus 105 controls the sewing machine motor according to an instruction from the CPU 120 such that the sewing machine motor is rotationally driven. This moves a needle bar in the vertical direction, thereby forming a stitching pattern.

The swing/feed motor control apparatus 106 controls and drives a swing motor according to an instruction received from the CPU 120 so as to swing the needle bar, thereby providing a zig-zag operation of the needle bar. Furthermore, the swing/feed motor control apparatus 106 controls and drives a feed motor so as to control the feed amount and front-back direction for the sewing target. That is to say, the sewing mechanism is controlled by the sewing machine motor, the swing motor, and the feed motor, so as to form a straight-line stitching pattern, a zig-zag stitching pattern, a design stitching pattern, or the like.

The display apparatus 108 is electrically connected to the CPU 120 via an external input/output apparatus. The display apparatus 108 has a multi-layer configuration in which the touch panel 109 described later is arranged such that it is superimposed on the lower side of the display face thereof. The touch panel 109 and the display apparatus 108 are integrated as a single unit, i.e., as the "display unit".

The touch panel 109 is configured as a touch panel employing an electrostatic capacitance method, a resistive film method, or the like. The touch panel 109 is electrically connected to the CPU 120. Furthermore, the touch panel 109 is arranged such that it is exposed to the exterior of the embroidery sewing machine 100 so as to allow the user to operate the embroidery sewing machine 100 giving consideration to convenience for the user in the operation. The user operates the touch panel 109 by touching the touch panel 109 with a finger. This allows the user to select a design, and the like, while monitoring such an operation for selecting a design or the like via the screen.

The tactile switch 110 is electrically connected to the CPU 120. The tactile switch 110 is configured as a group of operation buttons to be used by the user to perform a sewing operation, such as a sewing operation start/stop button, a thread cutting button, a threading button, and the like.

The CPU 120 controls the overall operation of the embroidery sewing machine 100 according to a control program stored in unshown ROM. The CPU 120 is connected to various kinds of devices via an external input/output apparatus. The unshown ROM and RAM each function as a storage unit that stores function modules. For example, the ROM stores various kinds of function modules and data such as an ordinary sewing design selection module, an embroidery sewing control module, an ordinary sewing control module, a built-in design data storage area, etc.

Outline of the Present Embodiment

As a related technique, a technique is known in which grouping (thread color grouping) is performed for each thread color with respect to data formed of the same number of thread colors or data to be sewn in the same sewing order with respect to the thread color. Also, with multi-needle sewing machines, another technique is known in which the number of times the thread spool is replaced is reduced for the thread color to be used in the sewing multiple times.

However, in today's environment, such an embroidery sewing machine supports a large embroidery area, and supports arrangement of a large number and various kinds of designs. Furthermore, household single-needle embroidery sewing machines have become broadly popular. In this situation, the aforementioned related techniques have an issue of poor versatility.

The aforementioned issue occurs due to the following cause. That is to say, examples of design stitching data include data that support overlay sewing (which represents sewing for overlaying stitching patterns on the same portion). In overlay sewing, if the sewing order is changed, this changes the design itself. Accordingly, as a condition to be used for reducing the number of times the thread spool is replaced, such a related technique is applied to only a target having the same number of colors and to be sewn in the same color order. Alternatively, as a precondition, such a related technique is applied to only a multi-needle sewing machine that is capable of setting multiple thread colors.

Figure 3:
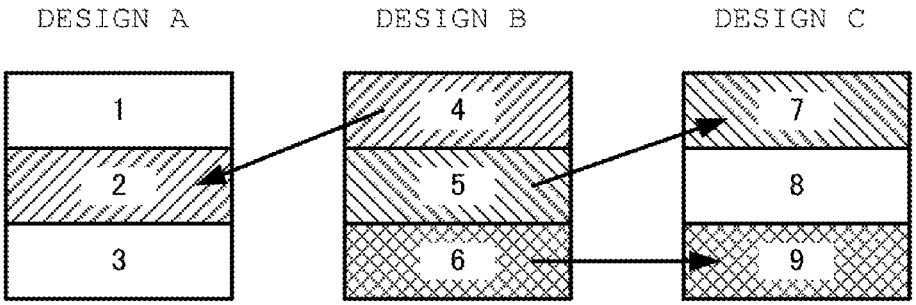
FIG. 3 is a diagram showing an example of a relation between the sewing order and the finished embroidery designs in the embroidery sewing machine according to the first embodiment of the present invention.
Figure 3:
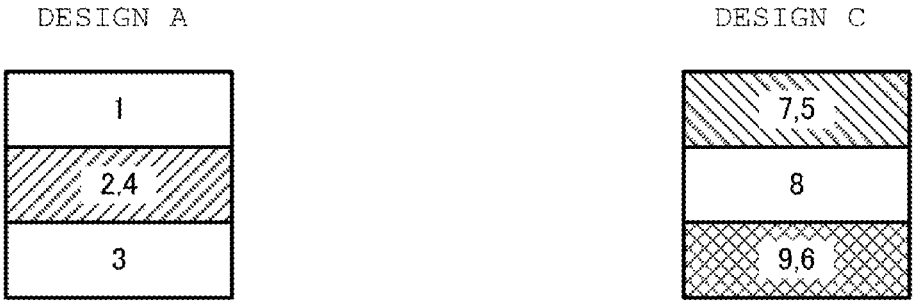

Description will be made regarding the outline of the present embodiment with reference to FIGS. 2 through 4.

As shown in FIG. 2, description will be made with reference to an example in which nine embroidery designs, i.e., a piano design (1), treble clef design (2), guitar design (3), violin design (4), harp design (5), clarinet design (6), drum design (7), euphonium design (8), and trumpet design (9) are arranged by editing.

FIG. 2 shows an image of a finished sewing design. FIG. 5 shows the sewing order and the number of thread colors for the finished sewing design. In the example shown in FIG. 2, thread colors are used as shown in FIG. 5. Simply thought, it is thus necessary to replace the thread spool 36 times. Assuming that 15 seconds is required for every replacement of the thread spool, in order to complete the embroidery sewing for all the designs, the thread spool replacement operation, which is a part of the embroidery sewing, requires 9 minutes. However, in some cases, particular thread colors from among the 36 thread colors are the same color. Accordingly, let us consider an arrangement in which such particular thread colors that are the same color are grouped so as to reduce the number of times the thread spool is to be replaced.

However, in a case in which such particular thread colors having the same color are grouped without any condition, such an arrangement leads to an issue of generating a different finished sewing image. Description will be made with reference to FIG. 4 regarding this issue.

Figure 4:
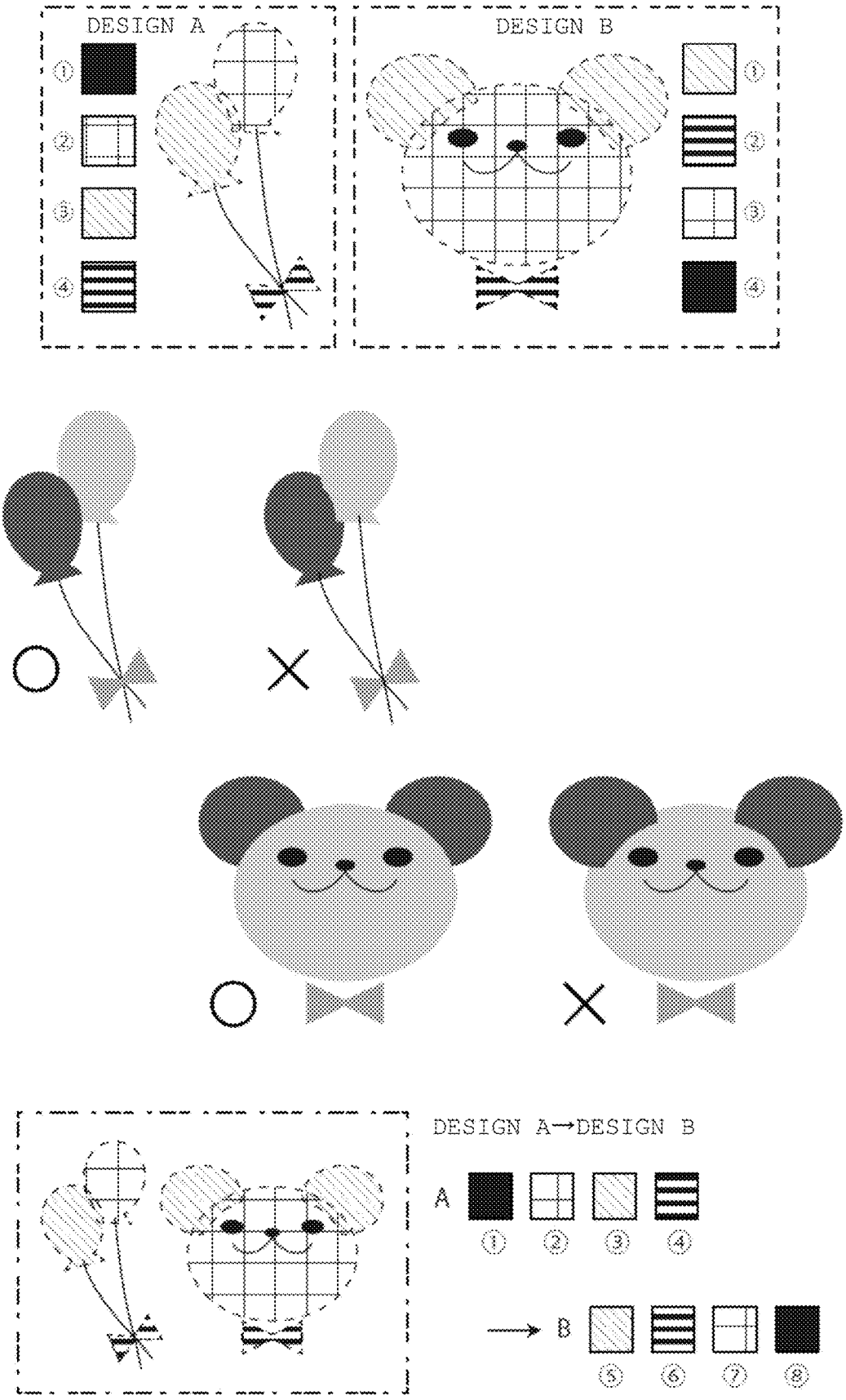
FIG. 4 is a diagram showing a concept of a thread color grouping operation of the embroidery sewing machine according to the first embodiment of the present invention.

FIG. 4 shows an example in which a balloon embroidery design (design A) and a bear embroidery design (design B) are arranged. Each embroidery design is formed of four thread colors. For example, in a case in which the balloon embroidery design (design A) is sewn in the order of thread color (4), thread color (3), thread color (2), and thread color (1), this provides a different balloon design indicated by "X" shown on the right in the middle of FIG. 4. In order to provide a finished balloon design indicated by the circle shown on the left in the middle of FIG. 4, the sewing must be performed in the order of thread color (1), thread color (2), thread color (3), and thread color (4). On the other hand, in a case in which the bear embroidery design (design B) is sewn in the order of thread color (4), thread color (3), thread color (2), and thread color (1), this provides a different bear design indicated by "X" shown on the right in the middle of FIG. 4. In order to provide a finished bear design indicated by the circle shown on the left in the middle of FIG. 4, the sewing must be performed in the order of thread color (1), thread color (2), thread color (3), and thread color (4). As described above, there is a close relationship between the sewing order and a finished embroidery design. In a case in which the number of times thread spool replacement is performed is reduced without giving consideration to this relationship, such an arrangement has no technical value.

In order to address such an issue, in the present embodiment, a method is provided in which such thread colors that are the same color as described above are selected and subjected to the grouping. In this operation, when judgment has been made that such given thread colors that are the same color can be sewn in a single batch without having an effect on the thread color order for each design, the thread color grouping is performed for such thread colors thus judged to be the same. This method is capable of reducing the number of times thread spool replacement is performed without having an adverse effect on the finished sewing image for each design.

With the present embodiment, as an example, judgment is made regarding whether or not the thread color grouping can be performed for each of the thread colors that form an arranged design in ascending order to be sewn. In the thread color grouping operation, whether or not there is a thread color for which the thread color grouping can be performed is judged in ascending order from the first thread color or otherwise in descending order from the last thread color in the sewing order for the design components that form a design. For example, the thread color to be sewn first in a given design can be sewn together with another thread color that is the same color in another design to be sewn before the given design without having an effect on an overlay structure of the second and subsequent thread colors. Also, the thread color to be sewn last in a given design can be sewn together with another thread color that is the same color in another design to be sewn after the given design without having an effect on an overlay structure of the second and subsequent thread colors.

For example, as shown in FIG. 3A, let us consider a case in which design A is sewn in the sewing order of the thread colors 1 through 3, design B is sewn in the sewing order of the thread colors 4 through 6, design C is sewn in the sewing order of the thread colors 7 through 9, the thread colors are the same color, the thread colors 5 and 7 are the same color, and the thread colors 6 and 9 are the same color. In this case, the thread color grouping can be performed as described in FIG. 3B.

It should be noted that this operation does not involve a change in the sewing order for design B. In contrast, the thread color grouping is not performed for the thread colors in the same design even if they are the same color. For example, the thread colors 1 and 3 in the design A are not subjected to the thread color grouping. In this case, sewing is performed in the same manner as with a case in which a single design has different thread colors that are different colors.

[Outline of Operation]

Figure 6:
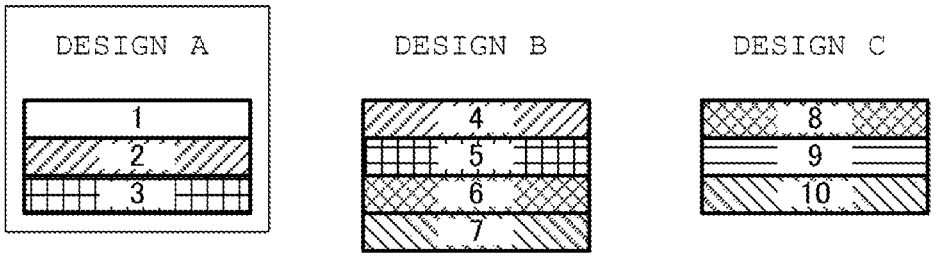
FIG. 6 is a diagram for explaining the thread color grouping operation with reference to a simple example.
Figure 6:
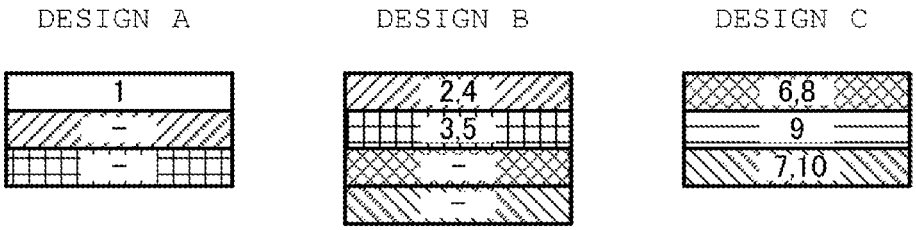
Figure 7:
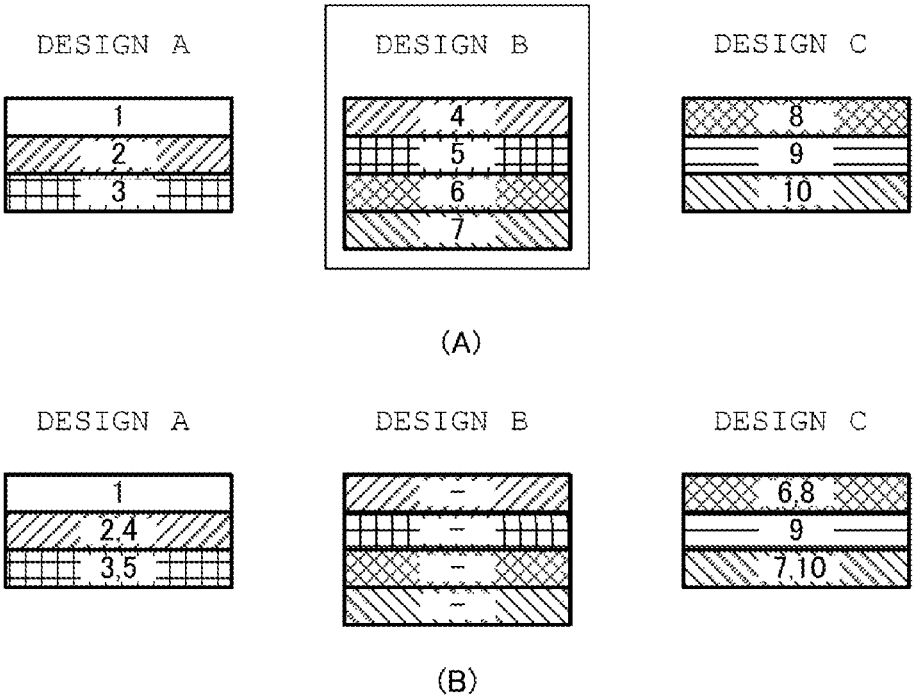
FIG. 7 is a diagram for explaining the thread color grouping operation with reference to a simple example.
Figure 8:
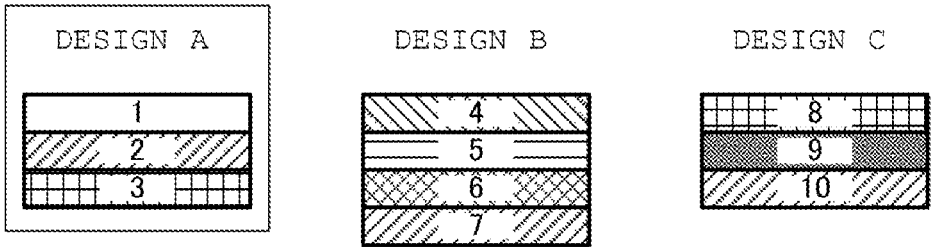
FIG. 8 is a diagram for explaining the thread color grouping operation with reference to a simple example.
Figure 8:
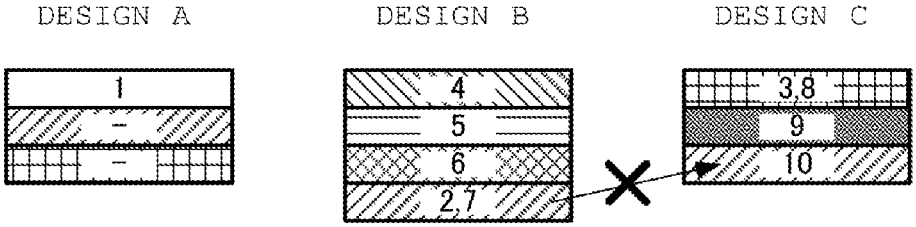

Before detailed description of typical actual operations, description will be made regarding the outline of the operations with reference to FIGS. 6 through 8.

Before specific description of the operations, description will be made regarding the content of the main operations and rules used in the operations.

The main operations include a thread comparison operation, a thread color grouping operation, and a comparison target changing operation.

In the thread color comparison operation, a comparison and judgment is made regarding whether or not a given thread color (comparison target) that forms a given design is the same as a thread color (comparison reference) that forms another design that differs from the given design.

Furthermore, in the thread grouping operation, the thread grouping operation is performed such that the comparison target that has been judged to be the same as the comparison reference in the thread color comparison operation is to be sewn at the same timing as the comparison reference. In this stage, the comparison target is removed from the sewing of the design formed with the comparison target.

It should be noted that, in the thread color grouping operation, even when judgment has been made that the comparison target and the comparison reference are the same color in the thread color comparison operation, in the following case, the thread color grouping is not performed. That is to say, when there is any comparison reference that has already been grouped with another thread color of the comparison target design formed with the comparison target, and when its sewing is to be performed between the comparison target and the comparison reference that have been judged to be the same in the color comparison operation (examples of such a comparison reference include the comparison target in a case in which it has already been subjected as a comparison reference to the thread color grouping), the thread color grouping is not performed.

Furthermore, in the comparison target changing operation, the comparison target is changed.

In the operation for changing the comparison target, for example, the comparison target is changed to the next target in ascending order or otherwise in descending order. The changing order is switched from the ascending order to the descending order, or otherwise from the descending order to the ascending order. When there is no next comparison target to be subjected to the thread color grouping regardless of the changing order (ascending order/descending order), the comparison target is changed to a comparison target of other designs or the like.

It should be noted that there is no comparison target, the operation ends.

The operations are executed according to the following rules.

(1) The presence or absence of a design to be sewn before or after the comparison target design In a case in which there is a design to be sewn before the comparison target design, the comparison target is selected from among the thread colors of the comparison target design in ascending order from the first thread color. Furthermore, the comparison reference is selected from among the thread colors that form a design to be sewn before the comparison target design. Subsequently, the following operation (2) is performed.

On the other hand, in a case in which there is a design is to be sewn after the comparison target, the comparison target is selected from among the thread colors in the comparison target design in descending order from the last thread color. Furthermore, the comparison reference is selected from among the thread colors that form a design to be sewn after the comparison target design. Subsequently, the following operation (2) is performed.

(2) Whether or not the thread color of the comparison target is the same as the color of the comparison reference.

In this case, in a case in which the comparison target of the thread color is changed in ascending order, the comparison reference is selected from among any of the thread colors that form a design to be sewn before the comparison target is to be sewn. Conversely, in a case in which the comparison target of the thread color is changed in descending order, the comparison reference is selected from among any of the thread colors that form a design to be sewn after the comparison target.

When the thread color of the comparison target is the same color as the comparison reference, the thread grouping operation is performed. Subsequently, the comparison target changing operation is performed. Furthermore, judgment is made regarding whether or not the thread color of the next comparison target is the same color as the comparison reference.

Conversely, when the thread color of the comparison target is not the same as the thread color of the comparison reference, the thread color grouping operation is not performed. Subsequently, the comparison target changing operation is performed. Furthermore, judgment is made regarding whether or not the thread color of the next comparison target is the same as the thread color of the comparison reference.

In this case, even when judgment has been made that the comparison target and the comparison reference are the same color, in the following case, the thread color grouping is not performed. That is to say, when there is any comparison reference that has already been grouped with another thread color of the comparison target design formed with the comparison target, and when its sewing is to be performed between the comparison target and the comparison reference that have been judged to be the same in the color comparison operation, the thread color grouping is not performed. Subsequently, the comparison target changing operation is performed. Furthermore, judgment is made regarding whether or not the thread color of the next comparison target is the same as the thread color of the comparison reference.

Conversely, when the thread color of the comparison target is not the same as the thread color of the comparison reference, the comparison target changing operation is performed. Furthermore, judgment is made regarding whether or not the thread color of the next comparison target is the same as the thread color of the comparison reference.

Operation Example 1

Description will be made below with reference to the designs shown in FIGS. 6A and 7A as an example assuming the content of the main operations and the rules in the operations described above.

As shown in FIG. 6A, the design A is formed of three design components. The design components are configured as a thread color 1, a thread color 2, and a thread color 3, respectively. The design B is formed of four design components, which are configured as a thread color 4, a thread color 5, a thread color 6, and a thread color 7, respectively.

Furthermore, the design C is formed of three design components, which are configured as a thread color 8, a thread color 9, and a thread color 10, respectively.

It should be noted that description will be made assuming that the sewing is performed in the order of the design A, the design B, and the design C.

[Operation in a Case in which the Design a is Selected as the First Comparison Target Design]

First, description will be made regarding a case in which the design A shown in FIG. 6A is selected as the first comparison target design.

In this operation, judgment is performed regarding the above-described rule (1). That is to say, judgment is made regarding whether or not there is another design to be sewn before or after the comparison target design. In this case, judgment is made that there is no design to be sewn before the design A. However, there is a design to be sewn after the design A.

Furthermore, in a case in which the design A is set to the comparison target design, judgment is made based on the rule (2) that the comparison target thread color is to be changed in descending order. Accordingly, the comparison target is set to the first thread color in descending order (the last thread color in the sewing order), i.e., the thread color "3".

After the thread color "3" is selected as the comparison target, the comparison reference is selected from among any of the thread colors that form the design B or otherwise the design C.

The thread color comparison operation is performed based on the rule (2). In this operation, judgment is made that the comparison target "3" is the same color as the thread color "5" of the design B.

In this stage, there is no comparison reference that has been subjected to the thread color grouping with another thread color that differs from the thread color "3" and that forms the design A such that it is to be sewn between the thread colors "3" and "5". Accordingly, the thread color grouping is performed such that the thread colors "3" and "5" are sewn at the same sewing timing. In this stage, the comparison target "3" is removed from the sewing timing of the design A.

Subsequently, the comparison target is changed in descending order in the design A. The next comparison target is set to the thread color "2". In this stage, the thread color comparison operation is performed for the comparison target "2" with any of the thread colors that form the design B or otherwise the design C based on the rule (2).

The thread color comparison operation is performed based on the rule (2). In this operation, judgment is made that the comparison target "2" is the same color as the thread color "4" of the design B.

In this stage, there is no comparison reference that has been subjected to the thread color grouping with another thread color that differs from the thread color "2" and that forms the design A such that it is to be sewn between the thread colors "2" and "4". Accordingly, the thread color grouping is performed such that the thread colors "2" and "4" are sewn at the same sewing timing. In this stage, the comparison target "2" is removed from the sewing timing of the design A.

Subsequently, the comparison target is changed in descending order in the design A. The next comparison target is set to the thread color "1". In this stage, the thread color comparison operation is performed based on the rule (2) for the comparison target "1" with any of the thread colors that form the design B or otherwise the design C. As a result of the thread color comparison operation based on the rule (2), judgment is made that there is no comparison reference that is the same color as the comparison target.

In this stage, the comparison target is changed based on the rule (2) (from descending order to ascending order). However, there is no thread color to be sewn before the comparison target "1". Accordingly, the comparison target is selected from among one from among the thread colors that form the next design B.

It should be noted that, in a case of selecting the comparison target from the design B, there is a design to be sewn before the design B and a design to be sewn after the design B. Accordingly, first, the comparison target is set to the thread color to be sewn first in the comparison target design. The comparison target is sequentially changed in ascending order so as to perform the thread color comparison.

In this stage, first, the thread color "4" of the design B is selected as the comparison target. The comparison reference for the comparison target is selected based on the rule (1) from among the thread colors that form the design A to be sewn before the design B (it should be noted that, in this example, the thread colors "3" and "2" have been removed from the sewing timing for the design A, and accordingly, only the thread color "1" can be selected).

In this stage, comparison is made between the thread colors "4" and "1". As a result, judgment is made that the thread color "4" is not the same color as the thread color "1".

Accordingly, the comparison target changing operation is performed based on the rule (2). In this case, the comparison target selecting order is switched from ascending order to descending order (from the last color thread).

As a result, the thread color "7", which is the first thread color in descending order (the last thread color in the sewing order), is selected as the comparison target. Furthermore, the comparison reference is selected from among any of the thread colors that form the design C.

In this example, the comparison target "7" and the comparison reference "10" are the same color. Furthermore, there is no comparison reference that has already been subjected to the thread color grouping with another thread color that differs from the comparison target and that forms the comparison target design B such that it is to be sewn between the comparison target "7" and the comparison reference "10". Accordingly, the thread color grouping is performed, and the comparison target "7" is removed from the sewing timing for the design B.

Subsequently, the comparison target changing operation is performed. As a result, the comparison target is changed to the thread color "6".

In this case, the comparison target "6" and the comparison reference "8" are the same color. Furthermore, there is no comparison reference that has already been subjected to the thread color grouping with another thread color that differs from the comparison target and that forms the comparison target design B such that it is to be sewn between the comparison target "6" and the comparison reference "8". Accordingly, the thread color grouping is performed, and the comparison target "6" is removed from the sewing timing for the design B.

Subsequently, the comparison target is changed. As a result, the comparison target is set to the thread color "5".

However, the comparison target "5" is not the same as any of the thread colors that form the comparison reference design. Accordingly, the thread grouping is not performed.

Subsequently, the comparison target is changed based on the rule (2), and accordingly, the comparison target is selected from the thread colors that form the design C. In this case, the comparison target is set to the first thread color "8" in ascending order. However, the thread color "6" that is the same color as the thread color "8" has already been grouped with the thread color "8", and accordingly, and the thread color "6" has been removed from the sewing timing for the design B. Furthermore, there is no thread color that is the same as the comparison target "8" except for the thread color "6". Furthermore, there is no design to be sewn after the design C. Accordingly, the comparison target cannot be changed, and such comparison cannot be made in descending order.

That is to say, there is no comparison target to be subjected to the thread color comparison. Accordingly, the operation ends. As a result of the operation, the thread color grouping is performed as shown in FIG. 6B.

With the above-described operation, this arrangement allows the number of times thread color replacement is performed to be reduced from 10 to 6.

[Operation in a Case in which the Design B is Selected as the First Comparison Target Design]

Next, description will be made regarding a case in which the design B shown in FIG. 7A is selected as the first comparison target.

In this operation, judgment is made based on the aforementioned rule (1) regarding whether or not there is another design to be sewn before or after the comparison target design. In this case, there are designs to be sewn before and after the design B.

In this example, there is a design to be sewn before the design B. Accordingly, the comparison target is set based on the rule (2) to the thread color "4" which is to be sewn in the first sewing of the design B. Furthermore, the comparison reference is selected from among one of the thread colors that form the design A to be sewn before the design B.

The thread color comparison operation is performed based on the rule (2). In this operation, judgment is made that the thread color "4" of the design B is the same color as the thread color "2" of the design A.

In this stage, there is no comparison reference that has already been subjected to the thread color grouping with another thread color that differs from the comparison target "4" and that forms the comparison target design B such that it is to be sewn between the comparison target "4" and the comparison reference "2". Accordingly, the thread color grouping operation is performed such that the thread colors "4" and "2" are to be sewn at the same sewing timing.

In this stage, the comparison target "4" is removed from the sewing timing for the design B. In the same way, the comparison target is set to the next thread color "5" in ascending order. In this case, the thread color "5" is the same color as the thread color "3". Furthermore, there is no comparison reference that has already been subjected to the thread color grouping with another thread color that differs from the comparison target "5" and that forms the comparison target design B such that it is to be sewn between the comparison target and the comparison reference "3". Accordingly, the thread color grouping operation is performed such that the thread colors "5" and "3" are to be sewn at the same sewing timing. In this stage, the comparison target "5" is removed from the sewing timing for the design B.

Subsequently, the comparison target is changed in ascending order in the design B. In this case, the next comparison target is set to the thread color "6".

In this stage, the thread color comparison operation is performed based on the rule (2) for the comparison target "6" with any of the thread colors that form the design A. As a result of the thread color comparison operation based on the rule (2), judgment is made that there is no comparison reference that is the same color as the thread color "6". Accordingly, the comparison target changing order is changed (from ascending order to descending order). In this case, the comparison target is set to the thread color "7", which is the first in descending order (the last in the sewing order).

It should be noted that, in this stage, the comparison target changing order is changed (from ascending order to descending order). Accordingly, the comparison reference is set to a thread color from among those of the design C which is the design to be sewn after the comparison target design.

The thread color comparison operation is performed based on the rule (2). As a result, judgment is made that the thread color "7" of the design B is the same color as the thread color "10" of the design C. In this case, there is no comparison reference that has already been subjected to the thread color grouping with another thread color that differs from the thread color "10" that forms the design C such that it is to be sewn between the thread colors "7" and "10". Accordingly, the thread color grouping operation is performed such that the thread colors "10" and "7" are to be sewn at the same sewing timing.

In this stage, the comparison target "7" is removed from the sewing timing for the design B.

Subsequently, the comparison target is changed in descending order in the design B. The next comparison target is set to the thread color "6".

In this stage, the thread color comparison operation is performed based on the rule (2). As a result, judgment is made that the thread color "6" of the design B is the same color as the thread color "8" of the design C.

In this case, there is no comparison reference that has already been subjected to the thread color grouping with another thread color that differs from the thread color "6" that forms the design B such that it is to be sewn between the thread colors "6" and "8". Accordingly, the thread color grouping operation is performed such that the thread colors "8" and "6" are to be sewn at the same sewing timing.

In this stage, the comparison target "6" is removed from the sewing timing for the design B.

Subsequently, the comparison target is changed in descending order in the design B. The next comparison target is set to the thread color "5".

However, the comparison target "5" has already been grouped with the comparison reference "3" in the aforementioned thread color grouping. Accordingly, the comparison target "5" has already been removed from the sewing timing for the design B. The same can be said of the comparison target "4".

Accordingly, the comparison target is changed. In this case, the comparison target is set to one from among the thread colors that form the design C.

It should be noted that there is another design to be sewn before the design C. However, there is no design to be sewn after the design C. Accordingly, in a case of selecting the design C as the comparison target design, based on the rule (1), the comparison target is selected from among the thread colors of the design C in ascending order from the first thread color. Furthermore, the comparison reference is selected from among the thread colors that form another design to be sewn before the design C, i.e., the design A or design B.

In this example, there is no thread color in the design A that is the same color as the first thread color "8" of the design C.

All the thread colors of the design B have already been removed from the sewing timing for the design B.

Accordingly, the comparison target selecting order is changed to descending order.

That is to say, the comparison target is set to the last thread color "10" of the design C. However, there is no design to be sewn after the design C. That is to say, a comparison reference cannot be selected. Accordingly, the operation ends.

As a result of the operation, the color grouping is performed as shown in FIG. 7B.

With the above-described operation, this arrangement allows the number of times thread color replacement is performed to be reduced from 10 to 6. This operation provides the same result as with the case in which the design A is selected as the first comparison target design.

Operation Example 2

Description will be made below with reference to the designs A through C shown in FIG. 8A as an example regarding a case in which the thread color grouping operation is performed for all the designs with the design A as the comparison target design based on the content of the main operations and the rules in the operations described above.

As shown in FIG. 8A, the design A is formed of the thread colors 1, 2, and 3.

The design B is formed of the thread colors 4, 5, 6, and 7.

Moreover, the design C is formed of the thread colors 8, 9, and 10. Description will be made assuming that design sewing is performed in the order of the design A, design B, and design C.

First, the comparison target is set to one of the thread colors of the design A shown in FIG. 8A. In this step, judgment is made based on the aforementioned rule (1) regarding whether or not there is a design to be sewn before or after the comparison target design. In this case, there is no design to be sewn before the design A. However, there is another design to be sewn after the design A.

Accordingly, in a case of selecting the design A as the comparison target design, judgment is made that the thread color selected as the comparison target is changed in descending order from the last thread color. In this case, the comparison target is set to the thread color "3".

After the comparison target is set to the thread color "3", the comparison reference is selected from among the thread colors of the design B or otherwise the design C.

The thread color comparison operation is performed based on the rule (2). Judgement is made that the comparison target "3" is the same color as the thread color "8" of the design C.

In this stage, there is no comparison reference that has already been subjected to the thread color grouping with another thread color that differs from the thread color "3" that forms the design A such that it is to be sewn between the thread colors "3" and "8". Accordingly, the thread color grouping operation is performed such that the thread colors "3" and "8" are to be sewn at the same sewing timing. In this stage, the comparison target "3" is removed from the sewing timing for the design A.

Subsequently, the comparison target is changed in descending order in the design A. The next comparison target is set to the thread color "2". In this step, the thread color comparison operation is performed based on the rule (2) for the comparison target "2" with any of the thread colors that form the design B or otherwise the design C.

As a result of the thread color comparison operation based on the rule (2), judgment is made that the comparison target "2" is the same color as the thread color "7" and the thread color "10".

In this case, the comparison reference "8" has already been subjected to the thread color grouping with the thread color "3" such that it is to be sewn between the thread color "2" and the thread color "10". Accordingly, the thread color grouping is not performed for the thread colors "2" and "10".

In contrast, there is no comparison reference that has already been subjected to the thread color grouping with another thread color that differs from the thread color "2" that forms the design A such that it is to be sewn between the thread colors "2" and "7". Accordingly, the thread color grouping operation is performed such that the thread colors "2" and "7" are to be sewn at the same sewing timing.

In this stage, the comparison target "2" is removed from the sewing timing for the design A.

The comparison target is changed in descending order in the design A. In this case, the next comparison target is set to the thread color "1".

In this stage, the thread color comparison is performed based on the rule (2) for the comparison target "1" with any of the thread colors of the design B or the design C. As a result of the thread color comparison operation based on the rule (2), judgment is made that there is no comparison reference that is the same color as the comparison target "1".

In this case, the comparison target changing order is changed based on the rule (2) (from descending order to ascending order). However, there is no thread color to be sewn before the thread color "1". Accordingly, the comparison target is selected from among the thread colors that form the next design B.

It should be noted that, in a case of selecting the design B as the comparison target design, there is another design (design A) to be sewn before the design B and there is another design (design C) to be sewn after the design B. Accordingly, first, the comparison target is set to the thread color to be sewn first in the comparison target design B. Subsequently, the thread color comparison is performed for the comparison target sequentially selected in ascending order.

In this case, first, the thread color "4" of the design B is selected as the comparison target. Based on the rule (1), the comparison reference is selected from among the thread colors that form the design A to be sewn before the design B. However, there is no thread color in the design A (only the thread color "1" remains) to be sewn before the design B that is the same color as the thread color "4".

Accordingly, the comparison target changing order is changed based on the rule (2) (from descending order to ascending order). As a result, the comparison target is changed to the thread color "7" of the design B. The comparison reference is set to any of the thread colors of the design C.

In this stage, the thread color comparison is made based on the rule (2) between the thread color "7" of the design B and any of the thread colors of the design C.

As a result of the thread color comparison based on the rule (2), judgment is made that the thread color "7" is the same color as the thread color "10" of the comparison reference.

In this case, there is no comparison reference that has already been subjected to the thread color grouping with another thread color that differs from the thread color "7" that forms the design B such that it is to be sewn between the thread colors "7" and "10".

However, the comparison target "7" has already been subjected to the thread color grouping as a comparison reference with the thread color "2".

That is to say, the thread color "7" corresponds to a comparison reference in a case in which a comparison target has already been subjected to the thread color grouping as a comparison reference. The thread color "2" corresponds to a comparison target thus subjected to this thread color grouping.

In this case, in a case in which there is another comparison reference that has already been subjected to the thread color grouping with another thread color that forms the design A, and that differs from the thread color "2" of the design A, such that it is to be sewn between the comparison target and the comparison reference thus selected in the current comparison step, the thread color grouping is not performed.

In this example, the comparison reference "8" has already been subjected to the thread color grouping with the thread color "3" which differs from the color of the thread color "2" such that it is to be sewn between the comparison target "7" and the comparison reference "10" selected in the current comparison step.

Accordingly, the thread color grouping is not performed based on the rule (2).

The comparison target is changed (to the thread color in the next design) based on the rule (2). In this case, the comparison target is set to any of the thread colors of the design C. However, there is no thread color in the design A and the design B that is the same color as the first thread color of the design C, i.e., the thread color "8".

Subsequently, the comparison target order changing is performed (from ascending order to descending order). As a result, the comparison target is set to the last thread color "10". However, there is no design to be sewn after the design C. Accordingly, the operation ends.

With the above-described operation, this arrangement allows the number of times thread color replacement is performed to be reduced from 10 to 8. It should be noted that description has been made regarding a case in which the design A is selected as the first comparison target design. Also, in a case in which the design B is selected as the first comparison target design, such an arrangement provides the same result.

[Operation of Embroidery Sewing Machine]

Detailed description will be made with reference to FIG. 5 and FIGS. 9 through 15 regarding a typical actual operation of the embroidery sewing machine 100 according to the present embodiment with the designs shown in FIG. 2 as an example.

It should be noted that FIG. 5 shows the sewing order for the nine embroidery designs shown in FIG. 2 (with this sewing order, in this drawing, the sewing target design is sequentially changed from the left to the right, with the design (1) as the first design to be sewn, and with the design (9) as the last design to be sewn). Furthermore, FIG. 5 shows the design components that form each design and the sewing order in which the design components are to be sewn (with the design (1) as an example, the multiple design components (represented by a thread color code, e.g., "237" or the like) are represented by numbers in the order of 1 to 9). Specific description will be made below regarding the operation of the embroidery sewing machine 100 according to the present embodiment with reference to such designs as appropriate.

Also, for ease of understanding of the operation for each design, separate description will be made regarding the operations, i.e., the operation for the first design to be sewn first (FIG. 9), the operation for the last design to be sewn last (FIG. 13), and the operation for a design to be sewn between the first design and the last design (from FIG. 10 to FIG. 12).

[Operation for the Design to be Sewn First]

Figure 9:
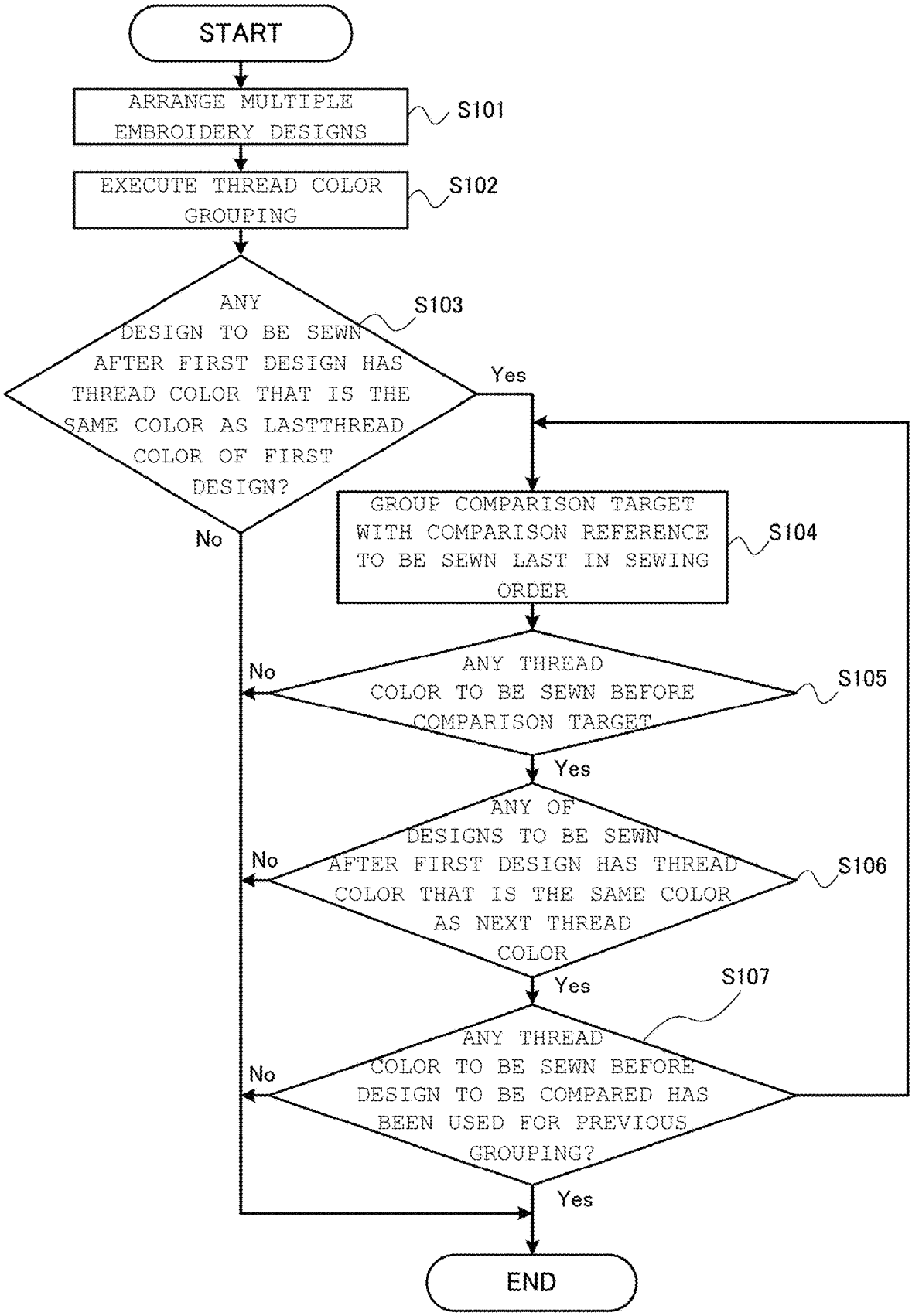
FIG. 9 is a flowchart showing the thread color grouping operation of the embroidery sewing machine according to the first embodiment of the present invention.

As shown in FIG. 9, first, the user operates a touch panel 109 so as to arrange multiple design data (Step S101).

After the arrangement of the embroidery data is completed, the user operates the touch panel 109 so as to execute a thread color grouping command for executing the thread color grouping operation (Step S102).

After the execution of the thread color grouping, the thread color comparison unit 102 judges, based on the data stored in the thread color storage unit 101, whether or not any design to be sewn after the first design has a thread color that is the same color as the last design component that forms the first design (Step S103).

It should be noted that there is no design to be sewn before the first design. Accordingly, the first thread color judgment is omitted. The operation is performed in order from the last thread color.

When the thread color comparison unit 102 has judged that any design to be sewn after the first design has the same thread color as the last design component that forms the first design (e.g., the code 272 in FIG. 5) ("YES" in Step S103), grouping is performed such that the last design component of the design (1) is to be sewn at the same timing at which the design component of another design that has been judged as the same thread color as the last design component (e.g., the code 272 in the design (9)) is to be sewn after the first design (Step S104).

Conversely, when the thread color comparison unit 102 has judged that none of the designs to be sewn after the first design has the same thread color as the last design component of the first design ("NO" in Step S103), the operation for this thread color ends.

After the execution of the grouping (Step S104), the thread color comparison unit 102 judges whether or not there is any sewing data for a different thread color to be sewn before the thread color of the comparison target design thus grouped (Step S105). When judgment has been made that there is such sewing data to be sewn before the thread color of the comparison target design thus grouped (in FIG. 5, the last thread color of the first design, i.e., the code 272 in the design (1)) ("YES" in Step S105), the flow proceeds to Step S106.

Conversely, when there is no such sewing data before the thread color of the comparison target design thus grouped ("NO" in Step S105), the operation for this thread color ends.

In Step S106, the thread color comparison unit 102 judges whether or not any of the designs (designs (2) through (9)) to be sewn after the first design (design (1)) has a thread color that is the same color as any of the thread colors (e.g., in FIG. 5, the code 003 through the code 237) to be sewn before the second-last thread color design component of the comparison target design (design (1)) (Step S106).

It should be noted that the thread colors of the design components to be sewn before the second-last design component of the comparison target design (design (1)) are judged based on the following conditions.

(1) Whether or not any of the designs (designs (2) through (9)) to be sewn after the comparison target design (design (1)) has a design component (comparison reference) that is the same color as the comparison target thread color.

(2) Whether or not any of the thread colors to be sewn before the comparison reference thread color thus judged to be the same color in (1) has not been subjected to grouping with a thread color of the comparison target design that differs from the thread color thus judged to be the same color in (1).

In a case in which the thread color of the comparison target design is grouped with the same thread color in another design, a situation is conceivable as shown in FIG. 14. That is to say, as described above, in a case in which the thread color grouping is performed from the last, the thread color code "237" in the design A is grouped with the thread color "237" in the design C.

Subsequently, the thread color code "002" in the design A is grouped with the thread color code "002" in the design B. Finally, they are grouped with the thread code "002" in the design C.

In a case of executing the grouping as described above, such an arrangement leads to an issue in that the thread color sewing order for the design A is changed (from the order of the thread code "002" and the thread code "237" to the order of the thread code "237" and the thread code "002".

Accordingly, in this case, the following two conditions are checked.

(1) The presence or absence of data grouping is checked. (For example, after the thread color code "237" in the design A is grouped with the thread color code "237" in the design C, the thread code "002" in the design A is grouped with the thread color code "002" in the design B. In this case, judgment is made that the thread code "002" in the design B is grouped as a thread color of the designs A and B.)

(2) When the comparison target thread color has been grouped (e.g., the thread color code "002" in the design A has been grouped with the thread color code "002" in the design B), when there is no grouped thread color (the thread color code "237" in the design A) in other designs to be sewn between the grouped comparison target thread color (thread color code "002" in the design B) and the grouped comparison reference in another design (the thread color code "002" in the design C), the flow returns to the step for checking the aforementioned conditions (1) and (2) (in the example shown in FIG. 14, there is such a match).

When there is such a match (the thread color code "237" in the design C), and when the thread color sewing order in any design thus grouped is changed (example in FIG. 14), further grouping is not performed for the grouped thread color (thread color code "002" in the design B).

Conversely, when the grouping operation does not involve a change of the thread color sewing order, the flow returns to the step for checking the aforementioned conditions (1) and (2).

In the step S106 and the subsequent steps, judgment is made based on the above-described conditions with respect to the thread colors (from the code 003 to the code 237) to be sewn after the last thread color in the first design (design (1)).

In Step S106, in the example shown in FIG. 5, when the thread color comparison unit 102 judges that any of the designs (designs (2) through (9)) to be sewn after the first design (design (1)) has a thread color that is the same color as any of the thread colors to be sewn before the last thread color of the first design (design (1)), i.e., the second-last thread color (code 003) to the ninth-last thread color (code 237), the flow proceeds to Step S107.

Conversely, in the example shown in FIG. 5, when the thread color comparison unit 102 judges that none of the other designs (designs (2) through (9)) to be sewn before the last thread color of the first design (design (1)) has a thread color that is the same color as any of the thread colors to be sewn before the last thread color of the first design (design (1)), i.e., the second-last thread color (code 003) to the ninth-last thread color (code 237), or otherwise, there is no thread color to be compared ("NO" in Step S106), the thread color grouping for the given thread color or design ends.

In Step S107, the thread color comparison unit 102 judges whether or not any of any of thread colors to be sewn before the design to be compared has been used for the previous grouping (Step S107).

When the thread color comparison unit 102 has judged that none of thread colors to be sewn before the comparison reference thread color has been used for the previous grouping ("YES" in Step S107), the flow returns to Step S104.

Conversely, when the thread color comparison unit 102 has judged that any of thread colors to be sewn before the comparison reference thread color has been used for the previous grouping ("NO" in Step S107), the operation for the given thread color ends.

[Operation for Designs Except for the Design to be Sewn First and the Design to be Sewn Last]

Figure 10:
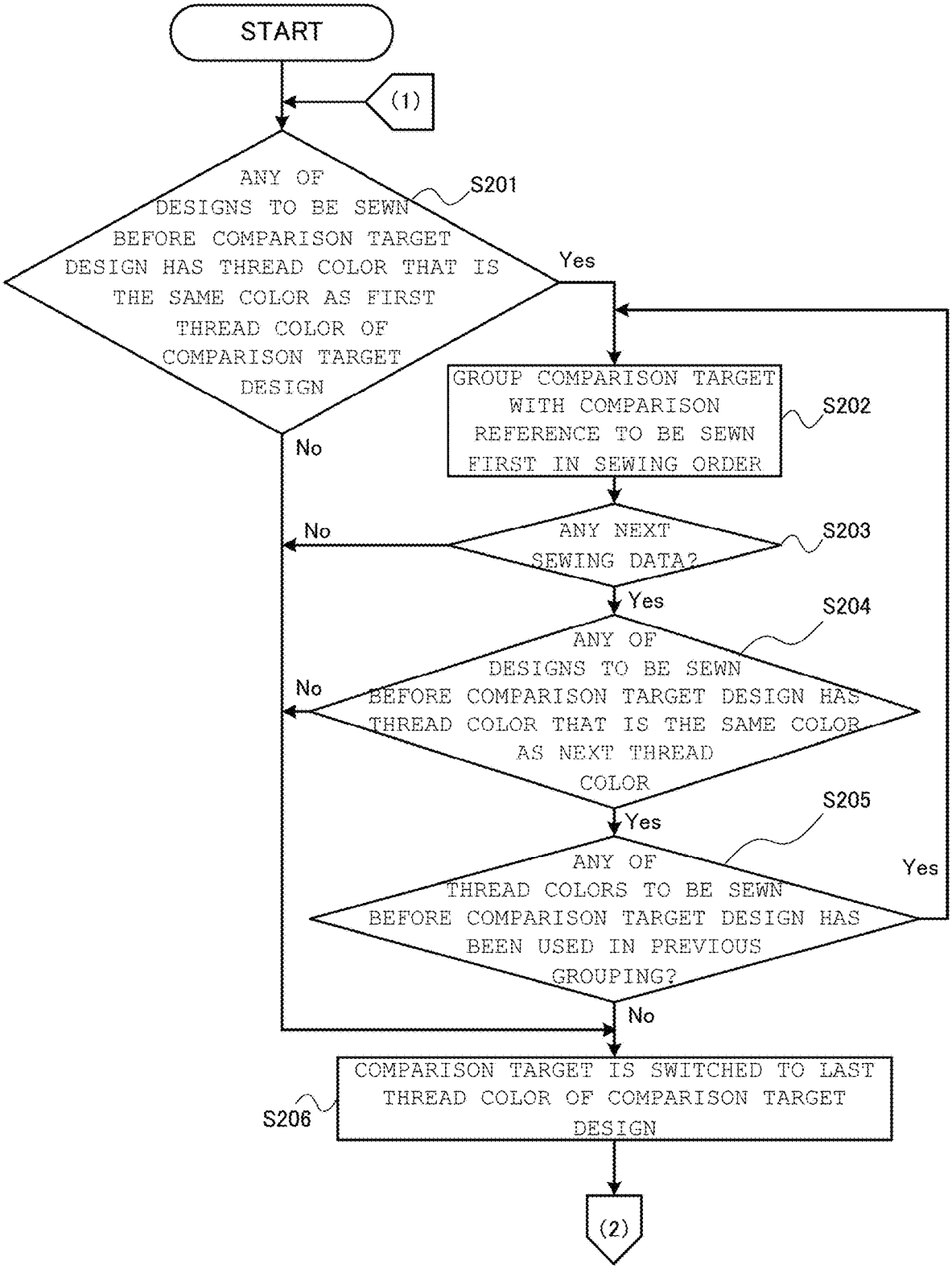
FIG. 10 is a flowchart showing the thread color grouping operation of the embroidery sewing machine according to the first embodiment of the present invention.

As shown in FIG. 10, the thread color comparison unit 102 judges, based on the data shown in FIG. 5 stored in the thread color storage unit 101, whether or not any design (e.g., the design (1) to be sewn first in the sewing order) to be sewn before the given comparison target design (any of designs (2) through (9)) has a thread color that is the same color as the thread color (e.g., in FIG. 5, the code 002 in the design (2)) of the given comparison target design to be sewn first (Step S201).

When the thread color comparison unit 102 has judged that a design to be sewn before the given comparison target design includes a thread color that is the same color as the thread color (e.g., in FIG. 5, the code 002 in the design (2)) of the given comparison target design to be sewn first ("YES" in Step S201), the flow proceeds to Step S202. In this step, the comparison target is grouped with the thread color (comparison reference) of the design to be sewn before the comparison target (grouping).

Figure 11:
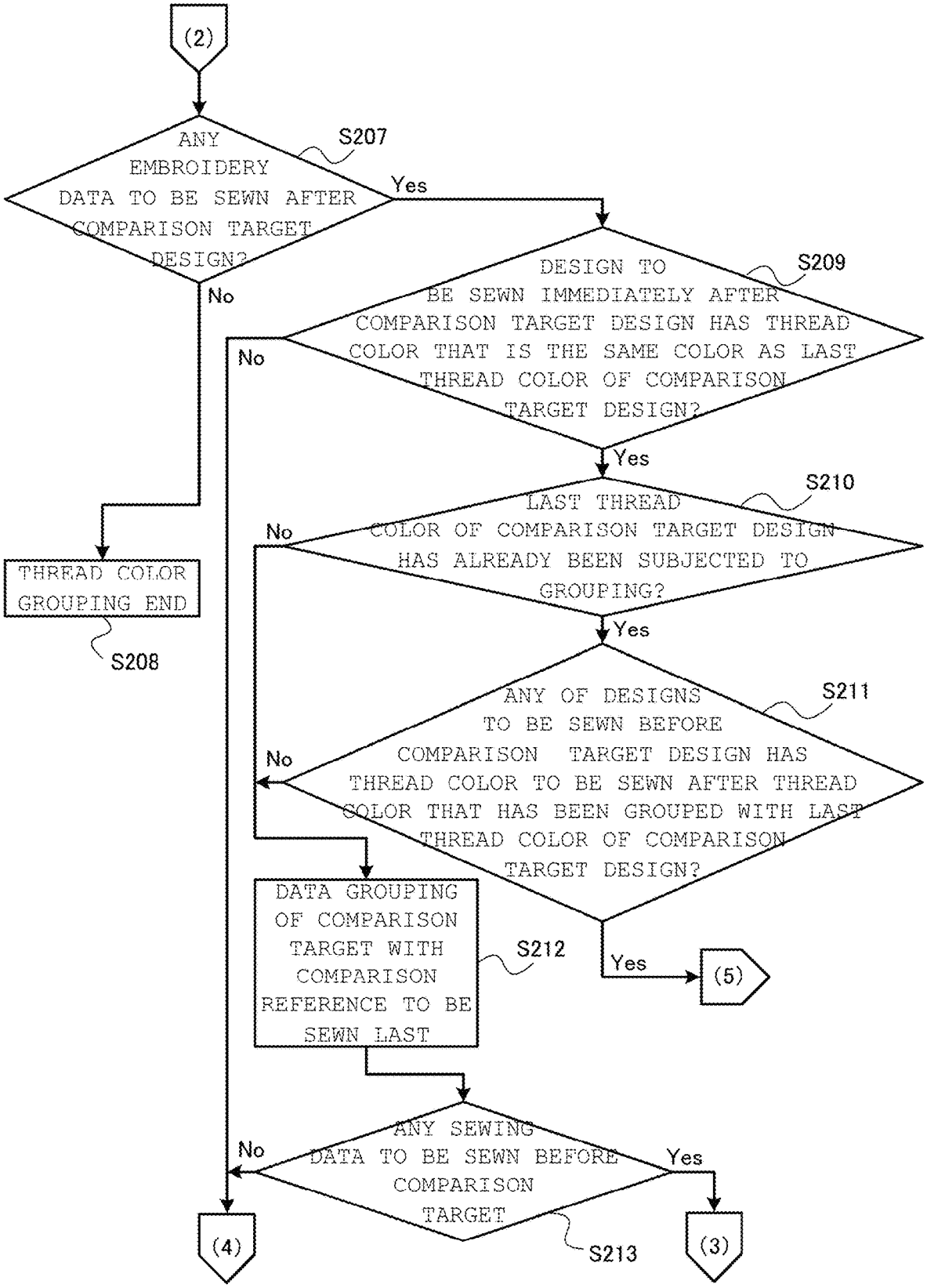
FIG. 11 is a flowchart showing the thread color grouping operation of the embroidery sewing machine according to the first embodiment of the present invention.

Conversely, when the thread color comparison unit 102 has judged that none of the designs to be sewn before the given comparison target includes a thread color that is the same color as the thread color (e.g., in FIG. 5, the code 002 in the design (2)) of the given comparison target design to be sewn first ("NO" in Step S201), the comparison target changing unit 104 changes the comparison target to be subjected to the operation to the thread color of the given comparison target design to be sewn last (Step S206), and the flow proceeds to Step S207 shown in FIG. 11.

After the operation in Step S202 (grouping), the thread color comparison unit 102 judges whether or not the given comparison target design has next-thread-color sewing data to be sewn after the thread color to be sewn first (Step S203). When judgment is made that there is next-thread-sewing data ("YES" in Step S203), the flow proceeds to Step S204.

Conversely, when the given comparison target design does not have next-thread-color sewing data ("NO" in Step S203), the comparison target changing unit 104 changes the comparison target to be subjected to the operation to the thread color of the given comparison target design to be sewn last (Step S206), and the flow proceeds to Step S207 shown in FIG. 11.

The thread color comparison unit 102 judges whether or not any of the designs to be sewn before the comparison target design has a thread color that is the same color as any one the thread colors to be sewn second and after in the sewing order in the comparison target design (Step S204). When the thread color comparison unit 102 has judged that any of the designs to be sewn before the comparison target design has a thread color that is the same color as a thread color to be sewn second and after in the sewing order in the comparison target design ("YES" in 204), the flow proceeds to Step S205.

Conversely, when the thread color comparison unit 102 has judged that none of the designs to be sewn before the comparison target design has no thread color that is the same color as any of the thread colors to be sewn second and after in the sewing order in the comparison target design ("NO" in 204), the comparison target changing unit 104 changes the comparison target to be subjected to the operation to the thread color to be sewn last in the sewing order in the given comparison target design (Step S206), and the flow proceeds to Step S207 shown in FIG. 11.

In Step S205, the thread color comparison unit 102 judges whether or not there is any thread color that has already been grouped in the previous grouping step (Step S202) such that it is to be sewn between the comparison reference and the comparison target (Step S205).

When the thread color comparison unit 102 has judged that there is no thread color that has already been grouped ("YES" in Step S205), the flow returns to Step S202. In this step, the grouping is performed.

Conversely, when the thread color comparison unit 102 has judged that there is a thread color that has already been subjected to grouping in the previous grouping step such that it is to be sewn between the comparison reference and the comparison target ("NO" in Step S205), the comparison target to be subjected to the operation is changed to the thread color to be sewn last in the comparison target design (Step S206), and the flow proceeds to Step S207.

Subsequently, as shown in FIG. 11, the thread color comparison unit 102 judges whether or not there is any design to be sewn after the comparison target design (Step S207). When judgment has been made that there is a design to be sewn after the comparison target design ("YES" in Step S207), the flow proceeds to Step S209.

Conversely, when judgment has been made that there is no design to be sewn after the comparison target design ("NO" in Step S207), the thread color grouping operation ends (Step S208).

The thread color comparison unit 102 judges whether or not any of the designs to be sewn after the comparison target design has a thread color that is the same color as the thread color to be sewn last in the comparison target design (Step S209).

When the thread color comparison unit 102 has judged that any of the designs to be sewn after the comparison target design has such a thread color ("YES" in Step S209), the flow proceeds to Step S210. Conversely, when the thread color comparison unit 102 has judged that none of the designs to be sewn after the comparison target design has such a thread color ("NO" in Step S209), the flow proceeds to Step S217 shown in FIG. 12.

The thread color comparison unit 102 judges whether or not the last thread color of the comparison target design has already been subjected to grouping (Step S210). When the thread color comparison unit 102 judges that the last thread color of the comparison target design has already been subjected to grouping ("YES" in Step S210), the flow proceeds to Step S211.

Conversely, when the thread color comparison unit 102 judges that the last thread color of the comparison target design has not already been subjected to grouping ("NO" in Step S210), the comparison target is grouped with the comparison reference (S212), and judgment is made regarding whether or not the comparison target design has different thread color sewing data to be sewn before the comparison target (Step S213).

Figure 12:
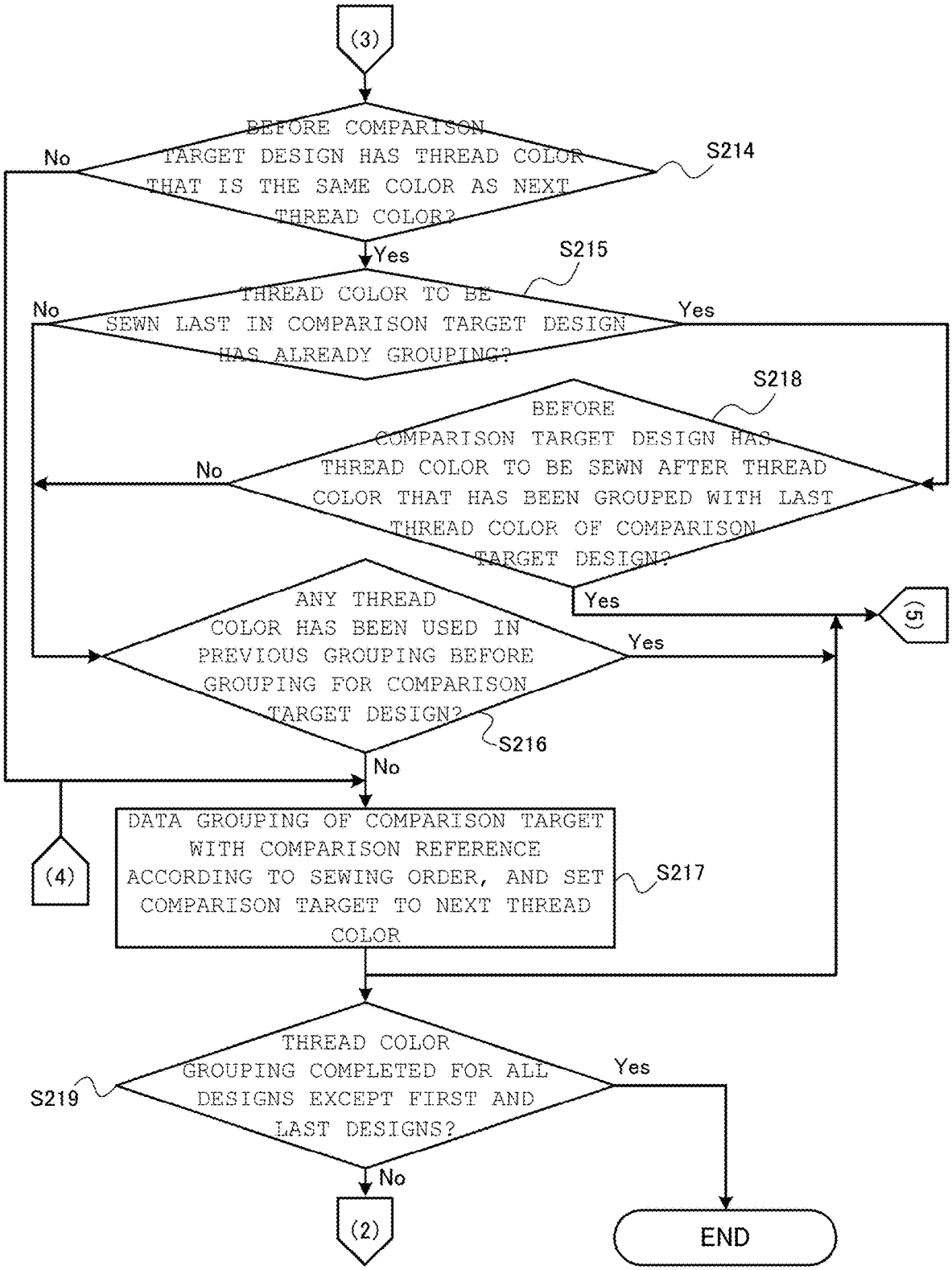
FIG. 12 is a flowchart showing the thread color grouping operation of the embroidery sewing machine according to the first embodiment of the present invention.

When judgment has been made that there is such thread color sewing data ("YES" in Step S213), the flow proceeds to Step S214 shown in FIG. 12.

Conversely, when judgment has been made that there is no thread color sewing data to be sewn before the comparison target ("NO" in Step S213), the flow proceeds to Step S217 shown in FIG. 12.

The thread color comparison unit 102 judges whether or not any of the thread colors to be sewn after the thread color that has already been grouped with the thread color to be sewn last in the comparison target design is to be sewn before the comparison target design (Step S211).

When the thread color comparison unit 102 has judged that any of thread colors to be sewn after the thread color that has already been grouped with the thread color to be sewn last in the comparison target design is to be sewn before the comparison target design ("YES" in Step S211), the flow proceeds to Step S219 shown in FIG. 12.

Conversely, when the thread color comparison unit 102 has judged that none of thread colors to be sewn after the thread color that has already been grouped with the thread color to be sewn last in the comparison target design is to be sewn before the comparison target design ("NO" in Step S211), the comparison target is grouped with the comparison target to be sewn last in the sewing order (Step S212). Furthermore, judgment is made regarding whether or not there is sewing data to be sewn before the comparison target design (S213).

When judgment has been made that there is sewing data to be sewn before the comparison target design ("YES" in Step S213), the flow proceeds to Step S214 shown in FIG. 12.

As shown in FIG. 12, the thread color comparison unit 102 judges whether or not any of the designs to be sewn before the comparison target design has a thread color that is the same color as any of the thread colors to be sewn in the comparison target design before the last thread color thereof (Step S214).

When the thread color comparison unit 102 has judged that any of the designs to be sewn before the comparison target design has a thread color that is the same color as any of the thread colors to be sewn in the comparison target design before the last thread color thereof ("YES" in Step S214), the flow proceeds to Step S215.

Conversely, when the thread color comparison unit 102 has judged that none of the designs to be sewn before the comparison target design has a thread color that is the same color as any of the thread colors to be sewn in the comparison target design before the last thread color thereof ("NO" in Step S214), the comparison target is grouped with the corresponding comparison reference data according to the sewing order. Furthermore, the comparison target changing unit 104 changes the comparison target to the next thread color (Step S217).

In this stage, judgment is made regarding whether or not the thread grouping has been completed for all the designs except the first design and the last design (Step S219). When judgment has been made that the thread grouping has not been completed for all the designs except the first design and the last design ("NO" in Step S219), the flow returns to Step S201.

Conversely, when judgment has been made that the thread grouping has been completed for all the designs except the first design and the last design ("YES" in Step S219), the operation ends.

The thread color comparison unit 102 judges whether or not the thread color to be sewn last in the comparison target design has been subjected to grouping (Step S215).

When the thread color comparison unit 102 has judged that the thread color to be sewn last in the comparison target design has been subjected to grouping ("YES" in Step S215), the flow proceeds to Step S218.

Conversely, when the thread color comparison unit 102 has judged that the thread color to be sewn last in the comparison target design has not been subjected to grouping ("NO" in Step S215), the thread color comparison unit 102 judges whether or not the thread color to be sewn last in the comparison target design is the same as a color that has been used in the previous grouping before the grouping for the comparison target design (Step S216).

When the thread color comparison unit 102 has judged that the thread color to be sewn last in the comparison target design is the same as a color that has been used in the previous grouping before the grouping for the comparison target design ("YES" in Step S216), judgment is made regarding whether or not the thread color grouping has been completed for all the designs except the first design and the last design (S219). When judgment has been made that the thread color grouping has not been completed for all the designs except the first design and the last design ("NO" in S219), the flow returns to Step S201.

Conversely, when judgment has been made that the thread color grouping has been completed for all the designs except the first design and the last design ("YES" in S219), the operation ends.

On the other hand, when judgment has been made that the thread color to be sewn last in the comparison target design is not the same as a color that has been used in the previous grouping before the grouping for the comparison target design ("NO" in Step S216), the data grouping is performed in the sewing order. Furthermore, the comparison target changing unit 104 changes the comparison target to the next thread color, and judgment is made regarding whether or not the color grouping has been completed for all the designs except the first design and the last design (S219). When judgment has been made that the color grouping has not been completed for all the designs except the first design and the last design ("NO" in S219), the flow returns to Step S201.

Conversely, when judgment has been made that the color grouping has been completed for all the designs except the first design and the last design ("YES" in S219), the operation ends.

The thread color comparison unit 102 judges whether or not any of the designs to be sewn before the comparison target design has a thread color to be sewn after a thread color that has been grouped with the thread color to be sewn last in the comparison target design (Step S218).

When the thread color comparison unit 102 has judged that any of designs to be sewn before the comparison target design has such a thread color to be sewn after a thread color that has been grouped with the thread color to be sewn last in the comparison target design ("YES" in Step S218), judgment is made regarding whether or not the color grouping has been completed for all the designs except the first design and the last design (S219). When judgment has been made that the color grouping has not been completed for all the designs except the first design and the last design ("NO" in S219), the flow returns to Step S201.

Conversely, when judgment has been made that the color grouping has been completed for all the designs except the first design and the last design ("YES" in S219), the operation ends.

When the thread color comparison unit 102 has judged that none of the designs to be sewn before the comparison target design has such a thread color to be sewn after a thread color that has been grouped with the thread color to be sewn last in the comparison target design ("NO" in Step S218), the thread color comparison unit 102 judges whether or not the thread color to be sewn last in the comparison target is the same color as a thread color that has been used in the previous grouping before the grouping for the comparison target design (Step S216).

When the thread color comparison unit 102 has judged that the thread color to be sewn last in the comparison target design is the same color as a thread color that has been used in the previous grouping before the grouping for the comparison target design ("YES" in Step S216), judgment is made regarding whether or not the color grouping has been completed for all the designs except the first design and the last design (S219). When judgment has been made that the color grouping has not been completed for all the designs except the first design and the last design ("NO" in S219), the flow returns to Step S201.

Conversely, when judgment has been made that the color grouping has been completed for all the designs except the first design and the last design ("YES" in S219), the operation ends.

On the other hand, when the thread color comparison unit 102 has judged that the thread color to be sewn last in the comparison target design is not the same color as a thread color that has been used in the previous grouping before the grouping for the comparison target design ("NO" in Step S216), the data grouping is performed in the sewing order. Furthermore, judgment is made regarding whether or not the color grouping has been completed for all the designs except the first design and the last design (S219). When judgment has been made that the color grouping has not been completed for all the designs except the first design and the last design ("NO" in S219), the flow returns to Step S201.

Conversely, when judgment has been made that the color grouping has been completed for all the designs except the first design and the last design ("YES" in S219), the operation ends.

[Operation for the Design to be Sewn Last]

Figure 13:
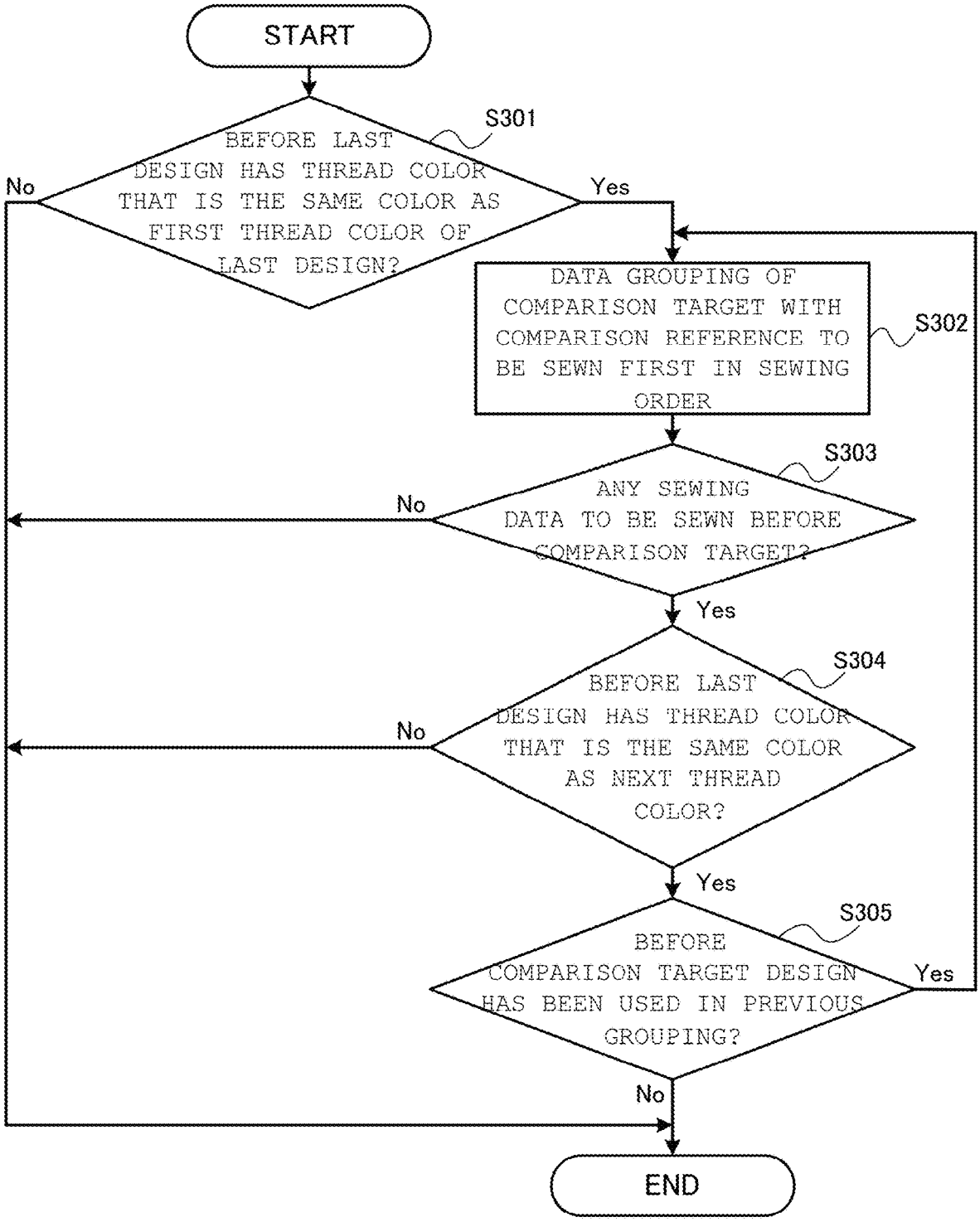
FIG. 13 is a flowchart showing the thread color grouping operation of the embroidery sewing machine according to the first embodiment of the present invention.

As shown in FIG. 13, the thread color comparison unit 102 judges, based on the data stored in the thread color storage unit 101, whether or not any of the designs to be sewn before the last design has a thread color that is the same color as the thread color to be sewn first in the last design (e.g., in FIG. 5, code 272) (Step S301).

It should be noted that there is no design to be sewn after the last design. Accordingly, judgment for the last thread color is omitted. The operation is performed from the first thread color.

When the thread color comparison unit 102 has judged that any of designs to be sewn before the last design has a thread color that is the same color as the thread color to be sewn first in the last design (e.g., in FIG. 5, code 272) ("YES" in Step S301), the flow proceeds to Step S302.

Conversely, when the thread color comparison unit 102 has judged that none of the designs to be sewn before the last design has a thread color that is the same color as the thread color to be sewn first in the last design (e.g., in FIG. 5, code 272) ("NO" in Step S301), the operation for the given thread color ends.

When the thread color comparison unit 102 has judged that any of designs to be sewn before the last design has a thread color that is the same color as the thread color to be sewn first in the last design (e.g., in FIG. 5, code 272) ("YES" in Step S301), the comparison target is grouped with the corresponding comparison reference data to be sewn first in the sewing order (Step S302).

Subsequently, the thread color comparison unit 102 judges whether or not there is any data to be sewn before the comparison target (Step S303). When judgment has been made that there is such data to be sewn before the comparison target (i.e., there is thread color data to be sewn before the thread color to be sewn first in the last design) ("YES" in Step S303), the flow proceeds to Step S304.

Conversely, if there is no such data ("NO" in Step S303), the operation for the given thread color ends.

In Step S304, the thread color comparison unit 102 judges whether or not any of the designs to be sewn before the last design has a thread color that is the same color as any of the thread colors of the last design to be sewn second or after in the sewing order (e.g., in FIG. 5, the code 003 to code 001 in the design (9)) (Step S304).

When the thread color comparison unit 102 has judged that a design to be sewn before the last design has a thread color that is the same color as a thread color of the last design to be sewn second or after in the sewing order (e.g., in FIG. 5, the code 003 to code 001) ("YES" in Step S304), the flow proceeds to Step S305.

Conversely, when the thread color comparison unit 102 has judged that none of the designs to be sewn before the last design has a thread color that is the same color as a thread color of the last design to be sewn second or after in the sewing order (e.g., in FIG. 5, the code 003 to code 001), or otherwise that there is no thread color to be compared ("NO" in Step S304), the thread color grouping for the given thread color or design ends.

In Step S305, the thread color comparison unit 102 judges whether or not any of the thread colors to be sewn before the comparison target design has been used in the previous grouping for any of the thread colors to be sewn second or after in the last design (Step S305).

When the thread color comparison unit 102 has judged that none of the thread colors to be sewn before the comparison target design has been used in the previous grouping for any of the thread colors to be sewn second or after in the last design ("YES" in Step S305), the flow returns to Step S302.

Conversely, when the thread color comparison unit 102 has judged that any of the thread colors to be sewn before the comparison target design has been used in the previous grouping for any of the thread colors to be sewn second or after in the last design ("NO" in Step S305), the operation for the given thread color ends.

Subsequently, after the operation from Step S302 to Step S305 is executed for the remaining thread colors of the last design up to the thread color to be sewn last in the sewing order, all the operations for the last design end.

It should be noted that, in a case shown in FIG. 5, the last thread color of the design (1) matches the first thread color (code 272) of the design (5). Accordingly, the thread color comparison unit 102 instructs the flow to proceed to Step S104.

In this step, the last thread color of the design (1) is grouped with the first thread color of the design (5).

Furthermore, in such a case shown in FIG. 5, there is sewing data (code 003) to be sewn before the comparison target. Accordingly, the flow proceeds to Step S106.

Furthermore, in such a case shown in FIG. 5, the sewing data for the design 2 and the subsequent designs are checked regarding whether or not any of them has a thread color that is the same color as the thread color (code 003) of the design (1) to be sewn second last in the sewing order.

In this step, even if judgment has been made that there is a thread color that is the same color, in a case in which a thread color (code 272) that has already been grouped before this step is to be sewn before the comparison target, the grouping is not performed in this step. As a result of the judgment, the thread color of the design (1) to be sewn second last in the sewing order matches the thread color (code 003) of the design (3) to be sewn second in the sewing order. Accordingly, the comparison target is grouped with the thread color (code 003) of the design (3) to be sewn second in the sewing order.

Subsequently, judgment is made for the thread color of the design (1) to be sewn third last (code 259). The sewing data for the design (2) and the subsequent designs are checked regarding whether or not any of them has a thread color that matches the given thread color (code 259).

In this step, even if judgment has been made that there is a thread color that is the same color, in a case in which any of the thread colors (codes 272 and 003) that have already been grouped before this step is to be sewn before the comparison target, the grouping is not performed in this step. In the case shown in FIG. 5, there is no thread color that matches the comparison target. Accordingly, judgment for the design (1) ends.

In such a case shown in FIG. 5, the design (2) has only one thread color. However, the operation is performed in the same manner as with a case in which the design has multiple thread colors.

First, judgment is made regarding whether or not any of the designs to be sewn before the design (2) has a thread color that is the same color as the thread color (code 002) of the design (2) to be sewn first in the sewing order.

In this case, there is no thread color that matches the comparison target, and consequently, the judgment for the thread color to be sewn first in the sewing order ends. Subsequently, judgment is made for the thread color of the design (2) to be sewn last in the sewing order.

That is to say, judgment is made regarding whether or not the design (3) and any of the subsequent designs has a thread color that is the same color as the thread color (code 002) of the design (2) to be sewn last in the sewing order.

In the example shown in FIG. 5, the thread color of the design (2) to be sewn last in the sewing order matches the thread color of the design (3) to be sewn last in the sewing order. Accordingly, the thread color of the design (2) to be sewn last in the sewing order is grouped with the thread color of the design (3) to be sewn last in the sewing order.

In this stage, there is no thread color in the design (2) to be sewn before the given thread color. Accordingly, judgment for the design (2) ends.

As described above, with the present embodiment, as shown in FIG. 15, in a case of applying the present embodiment to the example shown in FIG. 5, this arrangement allows the required number of thread colors to be reduced from 36, which is required before the present embodiment is applied, as shown in FIG. 15A to 24 as shown in FIG. 15B.

That is to say, the thread grouping is performed giving consideration to the sewing order. This arrangement allows the number of times thread spool replacement is performed to be reduced without having an adverse effect on the finished sewing image for each design. Furthermore, the thread color grouping according to the present embodiment can be employed regardless of whether the embroidery sewing machine is configured as a single-needle embroidery sewing machine or a multi-needle embroidery sewing machine, thereby providing an advantage of improved versatility.

Second Embodiment

Description will be made regarding to a second embodiment of the present invention with reference to FIGS. 16 and 17.

[Configuration of Embroidery Sewing Machine]

Description will be made with reference to FIG. 16 regarding a configuration of an embroidery sewing machine 200 according to the present embodiment.

Figure 16:
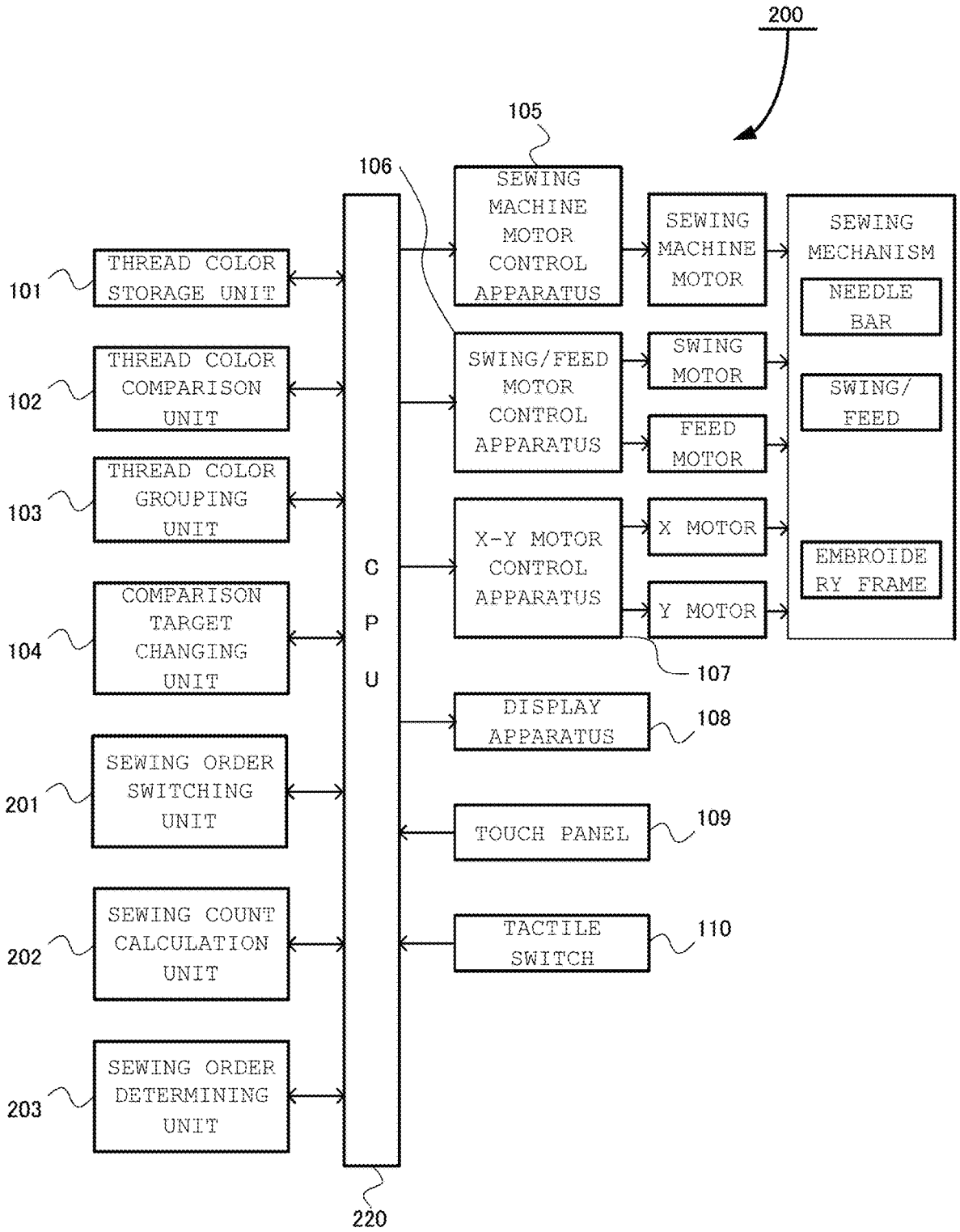
FIG. 16 is a configuration diagram showing an embroidery sewing machine according to a second embodiment of the present invention.
Figure 17:
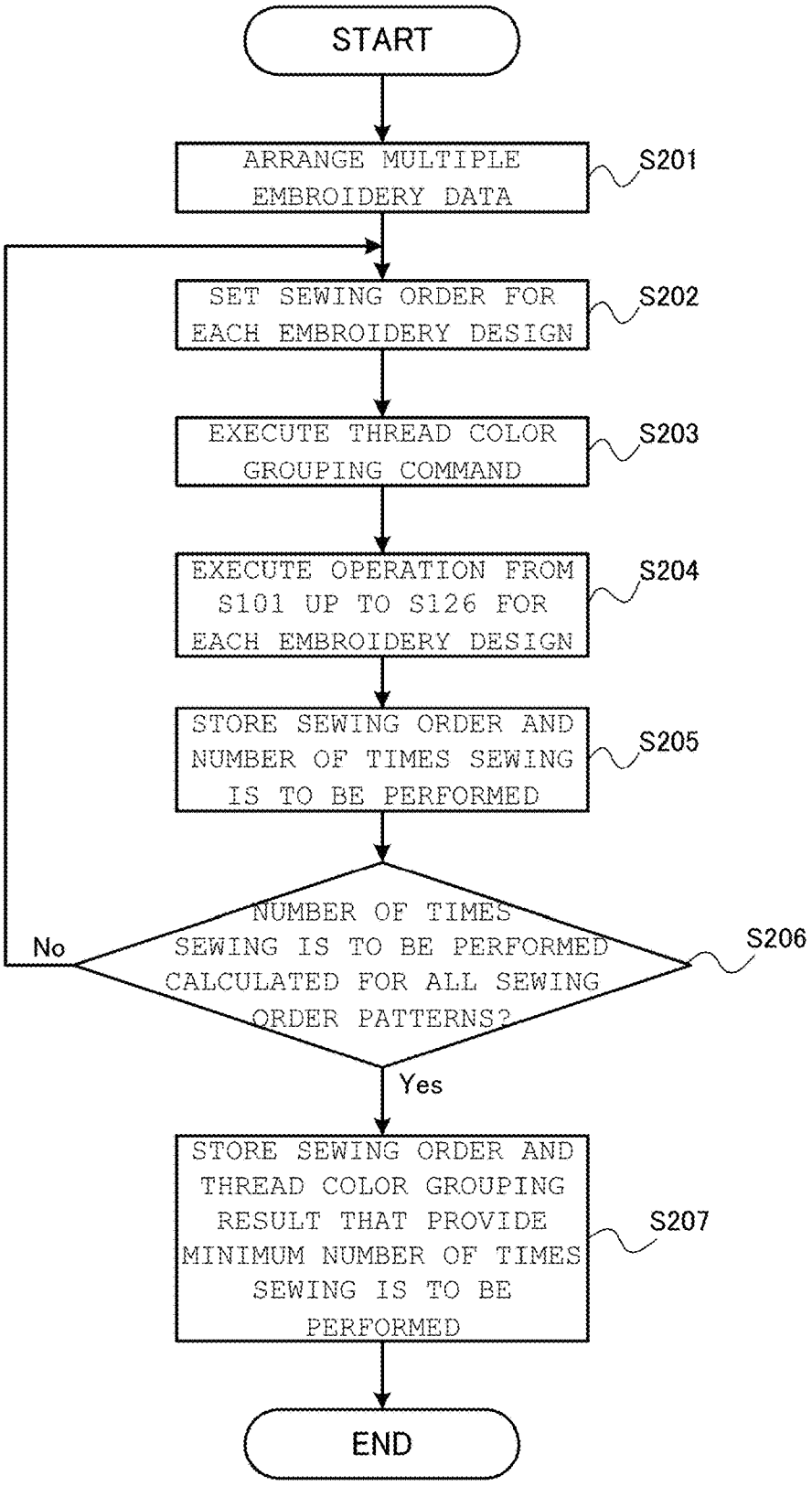
FIG. 17 is a flowchart showing the thread color grouping operation of the embroidery sewing machine according to the second embodiment of the present invention.

As shown in FIG. 16, the embroidery sewing machine 200 according to the present embodiment is configured including a thread color storage unit 101, a thread color comparison unit 102, a thread color grouping unit 103, a comparison target changing unit 104, a sewing machine motor control apparatus 105, a swing/feed motor control apparatus 106, an X-Y motor control apparatus 107, a display apparatus 108, a touch panel 109, a tactile switch 110, a central processing unit (CPU) 220, a sewing order switching unit 201, a sewing count calculation unit 202, and a sewing order determining unit 203. It should be noted that the components represented by the same reference numerals as in the first embodiment have the same functions. Accordingly, detailed description thereof will be omitted.

The sewing order switching unit 201 switches the sewing order of multiple designs.

The sewing count calculation unit 202 calculates the number of times the multiple designs are to be sewn when the sewing order switching unit 201 switches the sewing order.

The sewing order determining unit 203 determines the sewing order for the multiple designs.

Furthermore, the sewing order determining unit 203 determines the sewing order so as to provide the minimum number of times sewing is to be performed as calculated by the sewing count calculation unit 202, and instructs the thread color storage unit 101 to store the sewing order thus determined.

[Operation of Embroidery Sewing Machine]

Description will be made with reference to FIG. 17 regarding the operation of the embroidery sewing machine according to the present embodiment.

The user operates the touch panel 109 so as to arrange multiple embroidery data (Step S201).

After the arrangement of the embroidery data is completed, the sewing order switching unit 201 sets the sewing order for embroidery designs.

After the sewing order switching unit 201 sets the sewing order for the embroidery designs, the user operates the touch panel 109 so as to execute the thread color grouping command for executing the thread color grouping operation.

Upon executing the thread color grouping operation, the thread color comparison unit 102 executes the operation from Step S101 up to Step S126 shown in FIGS. 5 through 11 for each embroidery design (Step S204), and the CPU 220 instructs RAM to store the sewing order and the number of times sewing is to be performed (Step S205).

Subsequently, the CPU 220 judges whether or not the sewing count calculation unit 202 has calculated the number of times sewing is to be performed for all the sewing order patterns (Step S206).

When the CPU 220 has judged that the number of times sewing is to be performed has not been calculated for all the sewing order patterns ("NO" in Step S206), the flow returns to Step S202.

Conversely, when the CPU 220 has judged that the number of times sewing is to be performed has been calculated for all the sewing order patterns ("YES" in Step S206), the CPU 220 instructs the thread color storage unit 101 to store the sewing order and the thread grouping result that provide the minimum number of times sewing is to be performed (Step S207).

As described above, description has been made in the first embodiment regarding the method for reducing the number of times thread spool replacement is to be performed for a given sewing order. With the present embodiment, this arrangement is capable of acquiring the sewing order and the thread color grouping result that provides the minimum number of times sewing is to be performed based on the calculation results for all the sewing order patterns.

Accordingly, this arrangement allows the number of times thread spool replacement is to be performed to be reduced without damaging the finished image of each design.

Furthermore, the thread color storage unit 101 stores the sewing order and the thread grouping result that provide the minimum number of times sewing is to be performed. Accordingly, in a case in which the same embroidery design combination is to be sewn after a long period of time, by searching the thread color storage unit 101, this arrangement is capable of supporting the same sewing operation that provides the minimum number of times thread spool replacement is to be performed at any time without damaging the finished image of each design.

It should be noted that description has been made in the present embodiment regarding the embroidery sewing machine as an example. Also, a personal computer (PC) may be provided with functions that correspond to the thread color storage unit 101, the thread color comparison unit 102, the thread color grouping unit 103, the comparison target changing unit 104, the central processing unit (CPU) 120, the sewing order switching unit 201, the sewing count calculation unit 202, and the sewing order determining unit 203 as described above. The above-described operation may be executed on the personal computer (PC).

That is to say, the operation of the sewing machine according to the present embodiment may be recorded on a computer-system-readable or otherwise computer-readable recording medium in the form of a program. Also, such a program thus recorded on the recording medium may be read out and executed by the embroidery sewing machine or the personal computer (PC), thereby providing the present invention. Examples of such a computer system or computer as used here include an OS and a hardware component such as peripheral devices or the like.

Also, the "computer system or computer" encompasses website providing environments (or display environments) that employ the WWW (World Wide Web) system. Also, the aforementioned program may be transmitted to other computer systems or computers from a given computer system or computer that stores this program in its storage apparatus or the like via a transmission medium or otherwise transmission waves in the transmission medium. The "transmission medium" as used here to transmit a program represents a medium having a function of transmitting information, examples of which include networks (communication networks) such as the Internet and communication lines (communication wires) such as phone lines, etc.

Also, the aforementioned program may be configured to provide a part of the aforementioned functions. Also, the aforementioned program may be configured as a so-called differential file (differential program), which is to be combined with a different program stored beforehand in a computer system or a computer in order to provide the aforementioned functions.

It should be noted that although detailed description has been made regarding the embodiments of the present invention with reference to the drawings, specific configurations thereof are not restricted to these embodiments. Rather, various changes of design or the like may be made, which are encompassed by the present invention without departing from the spirit or scope of the present invention. For example, description has been made above regarding an example in which the embroidery sewing machine has the thread color grouping function as a built-in function. Also, the thread color grouping function may be supported by a different apparatus. Also, description has been made in the first and second embodiments regarding an example in which the thread color grouping is executed for all the thread colors. Also, the above-described operation may be executed for only the thread colors selected by the user as desired. Also, by visualizing the sewing data in the form of images for each color, or by generating a coordinate data layer, this arrangement may support a function for checking the overlay state with higher precision.

DESCRIPTION OF THE REFERENCE NUMERALS

100 embroidery sewing machine, 101 thread color storage unit, 102 thread color comparison unit, 103 thread color grouping unit, 104 comparison target changing unit, 105 sewing motor control apparatus, 106 swing/feed motor control apparatus, 107 X-Y motor control apparatus, 108 display apparatus, 109 touch panel, 110 tactile switch, 120 central processing unit (CPU), 200 embroidery sewing machine, 202 sewing count calculation unit, 203 sewing order determining unit.

What is claimed is:

1. An embroidery sewing machine comprising:

a thread color storage unit that stores thread colors to be sewn in a sewing order for each of a plurality of designs to be sewn;

a thread color comparison unit that compares and judges whether or not a thread color of a comparison target is the same as a thread color of a comparison reference; and a thread color grouping unit that groups the comparison target with the comparison reference when they have the same color, wherein: the comparison target is a portion having a design and a thread color; and the comparison reference is another portion that differs from the comparison target and has a design and a threat color, the design and the threat color of the comparison reference being stored in the thread color storage unit, and wherein, when the thread color comparison unit has judged that the comparison target is the same as the comparison reference, the thread color storage unit stores information such that the comparison target is to be sewn together with the comparison reference that has been judged to be the same, and the sewing data for the comparison target is removed.

2. The embroidery sewing machine according to claim 1, wherein, when any of comparison references to be sewn between the comparison target and the comparison reference that have been judged to be the same has already been grouped with a thread color of the comparison target design that differs from the color of the comparison target, the thread color grouping is not executed.

3. The embroidery sewing machine according to claim 1, wherein the thread color comparison unit compares the comparison target with the comparison reference in a sewing order, or otherwise in an order that is the reverse of the sewing order, for each of the comparison targets that form a comparison target design, wherein, when the comparison is made in the sewing order for the design formed with the comparison target, the comparison reference is set to a thread color of other designs to be sewn before the design formed with the comparison target, and wherein, when the comparison is made in an order that is the reverse of the sewing order for the design formed with the comparison target, the comparison reference is set to a thread color of other designs to be sewn after the design formed with the comparison target.

4. The embroidery sewing machine according to claim 1, further comprising a comparison target changing unit that changes the comparison target as appropriate based on comparison results obtained by the thread color comparison unit, wherein, in a case in which the comparison target is compared with the comparison reference in the sewing order for each comparison target that forms a comparison target design, when the thread color comparison unit has judged that the comparison target is not the same as the comparison reference, the comparison target is compared with the comparison reference in an order that is the reverse of the sewing order, or otherwise a predetermined thread color of a design to be sewn next in the sewing order is compared as the comparison target with the comparison reference.

5. The embroidery sewing machine according to claim 1, further comprising:

a sewing order switching unit that switches the sewing order in which the plurality of designs are to be sewn;

a sewing count calculation unit that calculates the number of times sewing is to be performed for the plurality of designs subjected to the thread color grouping supported by the thread color grouping unit when the sewing order switching unit switches the sewing order; and a sewing order determining unit that determines the order for the plurality of designs, wherein the sewing order determining unit determines the sewing order that provides the minimum number of times sewing is to be performed calculated by the sewing count calculation unit, and the thread color storage unit stores the sewing order thus determined and the thread color grouping result obtained by the thread color grouping unit.

6. A thread color grouping method employed in an apparatus comprising: a thread color storage unit that stores thread colors to be sewn in a sewing order for each of a plurality of designs to be sewn; a thread color comparison unit; and a thread color grouping unit, the thread color grouping method comprising:

a first step in which the thread color comparison unit judges whether or not a thread color of a comparison target is the same as a thread color of a comparison reference; and a second step in which the thread color grouping unit groups the comparison target with the comparison reference when they are the same color, wherein: the comparison target is a portion having a design and a thread color; and the comparison reference is another portion that differs from the comparison target and has a design and a threat color, the design and the threat color of the comparison reference being stored in the thread color storage unit, and wherein, in the second step, when the thread color comparison unit has judged that the comparison target is the same as the comparison reference, the thread color storage unit stores information such that the comparison target is to be sewn together with the comparison reference that has been judged to be the same, and the sewing data for the comparison target is removed.

7. The thread color grouping method according to claim 6, wherein, in the second step, when any of comparison references to be sewn between the comparison target and the comparison reference that have been judged to be the same in the first step has already been grouped with a thread color of the comparison target design that differs from the color of the comparison target, the thread color grouping is not executed.

8. The thread color grouping method according to claim 6, wherein, in the first step, the thread color comparison unit compares the comparison target with the comparison reference in a sewing order, or otherwise in an order that is the reverse of the sewing order, for each of the comparison targets that form a comparison target design, wherein, when the comparison is made in the sewing order for the design formed with the comparison target, the comparison reference is set to a thread color of another design to be sewn before the design formed with the comparison target, and wherein, when the comparison is made in an order that is the reverse of the sewing order for the design formed with the comparison target, the comparison reference is set to a thread color of another design to be sewn after the design formed with the comparison target.

9. The thread color grouping method according to claim 6, wherein the apparatus further comprises a comparison target changing unit that changes the comparison target as appropriate based on comparison results obtained in the first step, and wherein the thread color grouping method further comprises a third step in which, with the comparison target changing unit, in a case in which the comparison target is compared with the comparison reference in the sewing order for each comparison target that forms a comparison target design, when the thread color comparison unit has judged that the comparison target is not the same as the comparison reference, the comparison target is compared with the comparison reference in an order that is the reverse of the sewing order, or otherwise a predetermined thread color of a design to be sewn next in the sewing order is compared as the comparison target with the comparison reference.

10. The thread color grouping method according to claim 6, wherein the apparatus further comprises a sewing order switching unit, a sewing count calculation unit, and a sewing order determining unit, and wherein the thread color grouping method further comprises:

a fourth step in which the sewing order switching unit switches the sewing order in which the plurality of designs are to be sewn;

a fifth step in which the sewing count calculation unit calculates the number of times sewing is to be performed for the plurality of designs subjected to the thread color grouping performed in the second step when the sewing order is switched in the fourth step; and a sixth step in which the sewing order determining unit determines the sewing order that provides the minimum number of times sewing is to be performed calculated in the fifth step, and the thread color storage unit stores the sewing order thus determined and the thread color grouping result obtained in the second step.

11. A non-transitory recording medium that records a program for instructing a computer to execute a thread color grouping method employed in an apparatus comprising: a thread color storage unit that stores thread colors to be sewn in a sewing order for each of a plurality of designs to be sewn; a thread color comparison unit; and a thread color grouping unit, wherein the thread color grouping method comprises:

a first step in which the thread color comparison unit judges whether or not a thread color of a comparison target is the same as a thread color of a comparison reference; and a second step in which the thread color grouping unit groups the comparison target with the comparison reference when they are the same color, wherein: the comparison target is a portion having a design and a thread color; and the comparison reference is another portion that differs from the comparison target and has a design and a threat color, the design and the threat color of the comparison reference being stored in the thread color storage unit, and wherein, in the second step, when the thread color comparison unit has judged that the comparison target is the same as the comparison reference, the thread color storage unit stores information such that the comparison target is to be sewn together with the comparison reference that has been judged to be the same, and the sewing data for the comparison target is removed.

12. A non-transitory recording medium that records the program according to claim 11, wherein, in the second step, when any of comparison references to be sewn between the comparison target and the comparison reference that have been judged to be the same in the first step has already been grouped with a thread color of the comparison target design that differs from the color of the comparison target, the thread color grouping is not executed.

13. A non-transitory recording medium that records the program according to claim 11, wherein, in the first step, the thread color comparison unit compares the comparison target with the comparison reference in a sewing order, or otherwise in an order that is the reverse of the sewing order, for each of the comparison targets that form a comparison target design, wherein, when the comparison is made in the sewing order for the design formed with the comparison target, the comparison reference is set to a thread color of another design to be sewn before the design formed with the comparison target, and wherein, when the comparison is made in an order that is the reverse of the sewing order for the design formed with the comparison target, the comparison reference is set to a thread color of another design to be sewn after the design formed with the comparison target.

14. A non-transitory recording medium that records the program according to claim 11, wherein the apparatus further comprises a comparison target changing unit that changes the comparison target as appropriate based on comparison results obtained in the first step, and wherein the thread color grouping method further comprises a third step in which, with the comparison target changing unit, in a case in which the comparison target is compared with the comparison reference in the sewing order for each comparison target that forms a comparison target design, when the thread color comparison unit has judged that the comparison target is not the same as the comparison reference, the comparison target is compared with the comparison reference in an order that is the reverse of the sewing order, or otherwise a predetermined thread color of a design to be sewn next in the sewing order is compared as the comparison target with the comparison reference.

15. A non-transitory recording medium that records the program according to claim 11, wherein the apparatus further comprises a sewing order switching unit, a sewing count calculation unit, and a sewing order determining unit, and wherein the thread color grouping method further comprises:

a fourth step in which the sewing order switching unit switches the sewing order in which the plurality of designs are to be sewn;

a fifth step in which the sewing count calculation unit calculates the number of times sewing is to be performed for the plurality of designs subjected to the thread color grouping performed in the second step when the sewing order is switched in the fourth step; and a sixth step in which the sewing order determining unit determines the sewing order that provides the minimum number of times sewing is to be performed calculated in the fifth step, and the thread color storage unit stores the sewing order thus determined and the thread color grouping result obtained in the second step.

* * * * *